US008622127B2

(12) United States Patent
Kaminsky

(10) Patent No.: US 8,622,127 B2
(45) Date of Patent: Jan. 7, 2014

(54) OLEFIN REDUCTION FOR IN SITU PYROLYSIS OIL GENERATION

(75) Inventor: Robert D. Kaminsky, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 332 days.

(21) Appl. No.: 13/163,422

(22) Filed: Jun. 17, 2011

(65) Prior Publication Data

US 2012/0048545 A1 Mar. 1, 2012

Related U.S. Application Data

(60) Provisional application No. 61/378,274, filed on Aug. 30, 2010.

(51) Int. Cl.
*E21B 43/00* (2006.01)
*E21B 43/16* (2006.01)

(52) U.S. Cl.
USPC ..... 166/245; 166/272.4; 166/400; 166/270; 166/282; 166/268; 166/403; 166/272.3; 166/402; 166/264; 166/303; 166/252; 166/292; 166/305

(58) Field of Classification Search
None
See application file for complete search history.

(56) References Cited

U.S. PATENT DOCUMENTS

| | | | |
|---|---|---|---|
| 363,419 | A | 5/1887 | Poetsch |
| 895,612 | A | 8/1908 | Baker |
| 1,342,780 | A | 6/1920 | Vedder |
| 1,422,204 | A | 7/1922 | Hoover et al. |
| 1,666,488 | A | 4/1928 | Crawshaw |
| 1,701,884 | A | 2/1929 | Hogle |
| 1,872,906 | A | 8/1932 | Doherty |
| 2,033,560 | A | 3/1936 | Wells |
| 2,033,561 | A | 3/1936 | Wells |
| 2,534,737 | A | 12/1950 | Rose |
| 2,584,605 | A | 2/1952 | Merriam et al. |
| 2,634,961 | A | 4/1953 | Ljungstrom |
| 2,732,195 | A | 1/1956 | Ljungstrom |

(Continued)

FOREIGN PATENT DOCUMENTS

| | | |
|---|---|---|
| CA | 994694 | 8/1976 |
| CA | 1288043 | 8/1991 |

(Continued)

OTHER PUBLICATIONS

Ali, A.H.A, et al, (2003) "Watching Rocks Change-Mechanical Earth Modeling", *Oilfield Review*, pp. 22-39.

(Continued)

*Primary Examiner* — Angela M DiTrani
*Assistant Examiner* — Silvana Runyan
(74) *Attorney, Agent, or Firm* — ExxonMobil Upstream Research Company-Law Department

(57) ABSTRACT

Methods for improving the quality of hydrocarbon fluids produced by in situ pyrolysis or mobilization of organic-rich rock, such as oil shale, coal, or heavy oil. The methods involve reducing the content of olefins, which can lead to precipitation and sludge formation in pipelines and during storage of produced oils. The olefin content is reduced by arranging wells and controlling well pressures such that hydrocarbon fluids generated in situ are caused to pass through and contact pyrolyzed zones in which coke has been left. This contacting chemically hydrogenates a portion of the olefins in the pyrolysis oil by reducing the hydrogen content of the coke.

30 Claims, 9 Drawing Sheets

(56) References Cited

U.S. PATENT DOCUMENTS

| | | | |
|---|---|---|---|
| 2,777,679 | A | 1/1957 | Ljungstrom |
| 2,780,450 | A | 2/1957 | Ljungstrom |
| 2,795,279 | A | 6/1957 | Sarapuu |
| 2,812,160 | A | 11/1957 | West et al. |
| 2,813,583 | A | 11/1957 | Marx et al. |
| 2,847,071 | A | 8/1958 | De Priester |
| 2,887,160 | A | 5/1959 | De Priester |
| 2,895,555 | A | 7/1959 | De Priester |
| 2,923,535 | A | 2/1960 | Ljungstrom |
| 2,944,803 | A | 7/1960 | Hanson |
| 2,952,450 | A | 9/1960 | Purre |
| 2,974,937 | A | 3/1961 | Kiel |
| 3,004,601 | A | 10/1961 | Bodine |
| 3,013,609 | A | 12/1961 | Brink |
| 3,095,031 | A | 6/1963 | Eurenius et al. |
| 3,106,244 | A | 10/1963 | Parker |
| 3,109,482 | A | 11/1963 | O'Brien |
| 3,127,936 | A | 4/1964 | Eurenius |
| 3,137,347 | A | 6/1964 | Parker |
| 3,149,672 | A | 9/1964 | Orkiszewski et al. |
| 3,170,815 | A | 2/1965 | White |
| 3,180,411 | A | 4/1965 | Parker |
| 3,183,675 | A | 5/1965 | Schroeder |
| 3,183,971 | A | 5/1965 | McEver et al. |
| 3,194,315 | A | 7/1965 | Rogers |
| 3,205,942 | A | 9/1965 | Sandberg |
| 3,225,829 | A | 12/1965 | Chown et al. |
| 3,228,869 | A | 1/1966 | Irish |
| 3,241,611 | A | 3/1966 | Dougan |
| 3,241,615 | A | 3/1966 | Brandt et al. |
| 3,254,721 | A | 6/1966 | Smith et al. |
| 3,256,935 | A | 6/1966 | Nabor et al. |
| 3,263,211 | A | 7/1966 | Heidman |
| 3,267,680 | A | 8/1966 | Schlumberger |
| 3,271,962 | A | 9/1966 | Dahms et al. |
| 3,284,281 | A | 11/1966 | Thomas |
| 3,285,335 | A | 11/1966 | Reistle, Jr. |
| 3,288,648 | A | 11/1966 | Jones |
| 3,294,167 | A | 12/1966 | Vogel |
| 3,295,328 | A | 1/1967 | Bishop |
| 3,323,840 | A | 6/1967 | Mason et al. |
| 3,358,756 | A | 12/1967 | Vogel |
| 3,372,550 | A | 3/1968 | Schroeder |
| 3,376,403 | A | 4/1968 | Mircea |
| 3,382,922 | A | 5/1968 | Needham |
| 3,400,762 | A | 9/1968 | Peacock et al. |
| 3,436,919 | A | 4/1969 | Shock et al. |
| 3,439,744 | A | 4/1969 | Bradley |
| 3,468,376 | A | 9/1969 | Slusser et al. |
| 3,500,913 | A | 3/1970 | Nordgren et al. |
| 3,501,201 | A | 3/1970 | Closmann et al. |
| 3,502,372 | A | 3/1970 | Prats |
| 3,513,914 | A | 5/1970 | Vogel |
| 3,515,213 | A | 6/1970 | Prats |
| 3,516,495 | A | 6/1970 | Patton |
| 3,521,709 | A | 7/1970 | Needham |
| 3,528,252 | A | 9/1970 | Gail |
| 3,528,501 | A | 9/1970 | Parker |
| 3,547,193 | A | 12/1970 | Gill |
| 3,559,737 | A | 2/1971 | Ralstin |
| 3,572,838 | A | 3/1971 | Templeton |
| 3,599,714 | A | 8/1971 | Messman |
| 3,602,310 | A | 8/1971 | Halbert |
| 3,613,785 | A | 10/1971 | Closmann et al. |
| 3,620,300 | A | 11/1971 | Crowson |
| 3,642,066 | A | 2/1972 | Gill |
| 3,661,423 | A | 5/1972 | Garret |
| 3,692,111 | A | 9/1972 | Breithaupt et al. |
| 3,695,354 | A | 10/1972 | Dilgren et al. |
| 3,700,280 | A | 10/1972 | Papadopoulos et al. |
| 3,724,225 | A | 4/1973 | Mancini et al. |
| 3,729,965 | A | 5/1973 | Gartner |
| 3,730,270 | A | 5/1973 | Allred |
| 3,739,851 | A | 6/1973 | Beard |
| 3,741,306 | A | 6/1973 | Papadopoulos |
| 3,759,328 | A | 9/1973 | Ueber et al. |
| 3,759,329 | A | 9/1973 | Ross |
| 3,759,574 | A | 9/1973 | Beard |
| 3,779,601 | A | 12/1973 | Beard |
| 3,880,238 | A | 4/1975 | Tham et al. |
| 3,882,937 | A | 5/1975 | Robinson |
| 3,882,941 | A | 5/1975 | Pelofsky |
| 3,888,307 | A | 6/1975 | Closmann |
| 3,924,680 | A | 12/1975 | Terry |
| 3,943,722 | A | 3/1976 | Ross |
| 3,950,029 | A | 4/1976 | Timmins |
| 3,958,636 | A | 5/1976 | Perkins |
| 3,967,853 | A | 7/1976 | Closmann et al. |
| 3,978,920 | A | 9/1976 | Badyopadhyay |
| 3,999,607 | A | 12/1976 | Pennington et al. |
| 4,003,432 | A | 1/1977 | Paull et al. |
| 4,005,750 | A | 2/1977 | Shuck |
| 4,007,786 | A | 2/1977 | Schlinger |
| 4,008,762 | A | 2/1977 | Fisher et al. |
| 4,008,769 | A | 2/1977 | Chang |
| 4,014,575 | A | 3/1977 | French et al. |
| 4,030,549 | A | 6/1977 | Bouck |
| 4,037,655 | A | 7/1977 | Carpenter |
| 4,043,393 | A | 8/1977 | Fisher et al. |
| 4,047,760 | A | 9/1977 | Ridley |
| 4,057,510 | A | 11/1977 | Crouch et al. |
| 4,065,183 | A | 12/1977 | Hill et al. |
| 4,067,390 | A | 1/1978 | Camacho et al. |
| 4,069,868 | A | 1/1978 | Terry |
| 4,071,278 | A | 1/1978 | Carpenter et al. |
| 4,093,025 | A | 6/1978 | Terry |
| 4,096,034 | A | 6/1978 | Anthony |
| 4,125,159 | A | 11/1978 | Vann |
| 4,140,180 | A | 2/1979 | Bridges et al. |
| 4,149,595 | A | 4/1979 | Cha |
| 4,160,479 | A | 7/1979 | Richardson et al. |
| 4,163,475 | A | 8/1979 | Cha et al. |
| 4,167,291 | A | 9/1979 | Ridley |
| 4,169,506 | A | 10/1979 | Berry |
| 4,185,693 | A | 1/1980 | Crumb et al. |
| 4,186,801 | A | 2/1980 | Madgavkar et al. |
| 4,202,168 | A | 5/1980 | Acheson et al. |
| 4,239,283 | A | 12/1980 | Ridley |
| 4,246,966 | A | 1/1981 | Stoddard et al. |
| 4,250,230 | A | 2/1981 | Terry |
| 4,265,310 | A | 5/1981 | Britton et al. |
| 4,271,905 | A | 6/1981 | Redford et al. |
| 4,272,127 | A | 6/1981 | Hutchins |
| 4,285,401 | A | 8/1981 | Erickson |
| 4,318,723 | A | 3/1982 | Holmes et al. |
| 4,319,635 | A | 3/1982 | Jones |
| 4,320,801 | A | 3/1982 | Rowland et al. |
| 4,324,291 | A | 4/1982 | Wong et al. |
| 4,340,934 | A | 7/1982 | Segesman |
| 4,344,485 | A | 8/1982 | Butler |
| 4,358,222 | A | 11/1982 | Landau |
| 4,362,213 | A | 12/1982 | Tabor |
| 4,368,921 | A | 1/1983 | Hutchins |
| 4,369,842 | A | 1/1983 | Cha |
| 4,372,615 | A | 2/1983 | Ricketts |
| 4,375,302 | A | 3/1983 | Kalmar |
| 4,384,614 | A | 5/1983 | Justheim |
| 4,397,502 | A | 8/1983 | Hines |
| 4,401,162 | A | 8/1983 | Osborne |
| 4,412,585 | A | 11/1983 | Bouck |
| 4,417,449 | A | 11/1983 | Hegarty et al. |
| 4,468,376 | A | 8/1984 | Suggitt |
| 4,472,935 | A | 9/1984 | Acheson et al. |
| 4,473,114 | A | 9/1984 | Bell et al. |
| 4,474,238 | A | 10/1984 | Gentry et al. |
| 4,483,398 | A | 11/1984 | Peters et al. |
| 4,485,869 | A | 12/1984 | Sresty et al. |
| 4,487,257 | A | 12/1984 | Dauphine |
| 4,487,260 | A | 12/1984 | Pittman et al. |
| 4,495,056 | A | 1/1985 | Venardos |
| 4,511,382 | A | 4/1985 | Valencia et al. |
| 4,532,991 | A | 8/1985 | Hoekstra et al. |
| 4,533,372 | A | 8/1985 | Valencia et al. |
| 4,537,067 | A | 8/1985 | Sharp et al. |

(56) References Cited

U.S. PATENT DOCUMENTS 4,545,435 A 10/1985 Bridges et al.
4,546,829 A 10/1985 Martin et al.
4,550,779 A 11/1985 Zakiewicz
4,552,214 A 11/1985 Forgac et al.
4,567,945 A 2/1986 Segalman
4,585,063 A 4/1986 Venardos et al.
4,589,491 A 5/1986 Perkins
4,589,973 A 5/1986 Minden
4,602,144 A 7/1986 Vogel
4,607,488 A 8/1986 Karinthi et al.
4,626,665 A 12/1986 Fort
4,633,948 A 1/1987 Closmann
4,634,315 A 1/1987 Owen et al.
4,637,464 A 1/1987 Forgac et al.
4,640,352 A 2/1987 Vanmeurs et al.
4,671,863 A 6/1987 Tejeda
4,694,907 A 9/1987 Stahl et al.
4,704,514 A 11/1987 Van Egmond et al.
4,705,108 A 11/1987 Little et al.
4,706,751 A 11/1987 Gonduin
4,730,671 A 3/1988 Perkins
4,737,267 A 4/1988 Pao et al.
4,747,642 A 5/1988 Gash et al.
4,754,808 A 7/1988 Harmon et al.
4,776,638 A 10/1988 Hahn
4,779,680 A 10/1988 Sydansk
4,815,790 A 3/1989 Rosar et al.
4,817,711 A 4/1989 Jeambey
4,828,031 A 5/1989 Davis
4,860,544 A 8/1989 Krieg et al.
4,886,118 A 12/1989 Van Meurs et al.
4,923,493 A 5/1990 Valencia et al.
4,926,941 A 5/1990 Glandt et al.
4,928,765 A 5/1990 Nielson
4,929,341 A 5/1990 Thirumalachar et al.
4,974,425 A 12/1990 Krieg et al.
5,016,709 A 5/1991 Combe et al.
5,036,918 A 8/1991 Jennings et al.
5,050,386 A 9/1991 Krieg et al.
5,055,030 A 10/1991 Schirmer
5,055,180 A 10/1991 Klaila
5,082,055 A 1/1992 Hemsath
5,085,276 A 2/1992 Rivas et al.
5,117,908 A 6/1992 Hofmann
5,120,338 A 6/1992 Potts, Jr. et al.
5,217,076 A 6/1993 Masek
5,236,039 A 8/1993 Edelstein et al.
5,255,742 A 10/1993 Mikus
5,275,063 A 1/1994 Steiger et al.
5,297,626 A 3/1994 Vinegar et al.
5,305,829 A 4/1994 Kumar
5,372,708 A 12/1994 Gewertz
5,377,756 A 1/1995 Northrop et al.
5,392,854 A 2/1995 Vinegar et al.
5,411,089 A 5/1995 Vinegar et al.
5,416,257 A 5/1995 Peters
5,620,049 A 4/1997 Gipson et al.
5,621,844 A 4/1997 Bridges
5,661,977 A 9/1997 Shnell
5,730,550 A 3/1998 Andersland et al.
5,838,634 A 11/1998 Jones et al.
5,844,799 A 12/1998 Joseph et al.
5,868,202 A 2/1999 Hsu
5,899,269 A 5/1999 Wellington et al.
5,905,657 A 5/1999 Celniker
5,907,662 A 5/1999 Buettner
5,956,971 A 9/1999 Cole et al.
6,015,015 A 1/2000 Luft et al.
6,016,867 A 1/2000 Gregoli et al.
6,023,554 A 2/2000 Vinegar et al.
6,055,803 A 5/2000 Mastronarde et al.
6,056,057 A 5/2000 Vinegar et al.
6,079,499 A 6/2000 Mikus et al.
6,148,911 A 11/2000 Gipson et al.
6,158,517 A 12/2000 Hsu
6,246,963 B1 6/2001 Cross et al.
6,247,358 B1 6/2001 Dos Santos
6,328,104 B1 12/2001 Graue
6,434,435 B1 8/2002 Tubel et al.
6,480,790 B1 11/2002 Calvert et al.
6,540,018 B1 4/2003 Vinegar et al.
6,581,684 B2 6/2003 Wellington et al.
6,585,046 B2 7/2003 Neuroth et al.
6,589,303 B1 7/2003 Lokhandwale et al.
6,591,906 B2 7/2003 Wellington et al.
6,607,036 B2 8/2003 Ranson et al.
6,609,761 B1 8/2003 Ramey et al.
6,668,922 B2 12/2003 Ziauddin et al.
6,684,644 B2 2/2004 Mittricker et al.
6,684,948 B1 2/2004 Savage
6,708,758 B2 3/2004 de Rouffignac et al.
6,709,573 B2 3/2004 Smith
6,712,136 B2 3/2004 de Rouffignac et al.
6,715,546 B2 4/2004 Vinegar et al.
6,722,429 B2 4/2004 de Rouffignac et al.
6,742,588 B2 6/2004 Wellington et al.
6,745,831 B2 6/2004 de Rouffignac et al.
6,745,832 B2 6/2004 Wellington et al.
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al.
6,796,139 B2 9/2004 Briley et al.
6,820,689 B2 11/2004 Sarada
6,832,485 B2 12/2004 Surgarmen et al.
6,854,929 B2 2/2005 Vinegar et al.
6,858,049 B2 2/2005 Mittricker
6,877,555 B2 4/2005 Karanikas et al.
6,880,633 B2 4/2005 Wellington et al.
6,887,369 B2 5/2005 Moulton et al.
6,896,053 B2 5/2005 Berchenko et al.
6,896,707 B2 5/2005 O'Rear et al.
6,913,078 B2 7/2005 Shahin et al.
6,918,444 B2 7/2005 Passey et al.
6,923,258 B2 8/2005 Wellington et al.
6,932,155 B2 8/2005 Vinegar et al.
6,948,562 B2 9/2005 Wellington et al.
6,951,247 B2 10/2005 De Rouffignac et al.
6,953,087 B2 10/2005 de Rouffignac et al.
6,964,300 B2 11/2005 Vinegar et al.
6,969,123 B2 11/2005 Vinegar et al.
6,988,549 B1 1/2006 Babcock
6,994,160 B2 2/2006 Wellington et al.
6,997,518 B2 2/2006 Vinegar et al.
7,001,519 B2 2/2006 Linden et al.
7,004,247 B2 2/2006 Cole et al.
7,004,251 B2 2/2006 Ward et al.
7,011,154 B2 3/2006 Maher et al.
7,028,543 B2 4/2006 Hardage et al.
7,032,660 B2 4/2006 Vinegar et al.
7,036,583 B2 5/2006 de Rouffignac et al.
7,048,051 B2 5/2006 McQueen
7,051,807 B2 5/2006 Vinegar et al.
7,055,600 B2 6/2006 Messier et al.
7,063,145 B2 6/2006 Veenstra et al.
7,066,254 B2 6/2006 Vinegar et al.
7,073,578 B2 7/2006 Vinegar et al.
7,077,198 B2 7/2006 Vinegar et al.
7,077,199 B2 7/2006 Vinegar et al.
7,093,655 B2 8/2006 Atkinson
7,096,942 B1 8/2006 de Rouffignac et al.
7,096,953 B2 8/2006 de Rouffignac et al.
7,100,994 B2 9/2006 Vinegar et al.
7,104,319 B2 9/2006 Vinegar et al.
7,121,342 B2 10/2006 Vinegar et al.
7,124,029 B2 10/2006 Jammes et al.
7,165,615 B2 1/2007 Vinegar et al.
7,181,380 B2 2/2007 Dusterhoft et al.
7,198,107 B2 4/2007 Maguire
7,219,734 B2 5/2007 Bai et al.
7,225,866 B2 6/2007 Berchenko et al.
7,243,618 B2 7/2007 Gurevich
7,322,415 B2 1/2008 de St. Remey
7,331,385 B2 2/2008 Symington et al.

(56) References Cited

U.S. PATENT DOCUMENTS

| | | | | |
|---|---|---|---|---|
| 7,353,872 | B2 | 4/2008 | Sandberg | |
| 7,357,180 | B2 | 4/2008 | Vinegar et al. | |
| 7,441,603 | B2 | 10/2008 | Kaminsky et al. | |
| 7,461,691 | B2 | 12/2008 | Vinegar et al. | |
| 7,484,561 | B2 | 2/2009 | Bridges | |
| 7,516,785 | B2 | 4/2009 | Kaminsky | |
| 7,516,786 | B2 | 4/2009 | Dallas et al. | |
| 7,516,787 | B2 | 4/2009 | Kaminsky | |
| 7,546,873 | B2 | 6/2009 | Kim et al. | |
| 7,549,470 | B2 | 6/2009 | Vinegar et al. | |
| 7,556,095 | B2 | 7/2009 | Vinegar | |
| 7,617,869 | B2 | 11/2009 | Carney | |
| 7,631,691 | B2 | 12/2009 | Symington et al. | |
| 7,644,993 | B2 | 1/2010 | Kaminsky et al. | |
| 7,647,971 | B2 | 1/2010 | Kaminsky | |
| 7,647,972 | B2 | 1/2010 | Kaminsky | |
| 7,654,320 | B2 | 2/2010 | Payton | |
| 7,669,657 | B2 | 3/2010 | Symington et al. | |
| 7,743,826 | B2 | 6/2010 | Harris et al. | |
| 7,798,221 | B2 | 9/2010 | Vinegar et al. | |
| 7,857,056 | B2 | 12/2010 | Kaminsky et al. | |
| 7,860,377 | B2 | 12/2010 | Vinegar et al. | |
| 7,905,288 | B2 | 3/2011 | Kinkead | |
| 2001/0049342 | A1 | 12/2001 | Passey et al. | |
| 2002/0013687 | A1 | 1/2002 | Ortoleva | |
| 2002/0023751 | A1 | 2/2002 | Neuroth et al. | |
| 2002/0029882 | A1 | 3/2002 | Rouffignac et al. | |
| 2002/0049360 | A1 | 4/2002 | Wellington et al. | |
| 2002/0077515 | A1 | 6/2002 | Wellington et al. | |
| 2002/0099504 | A1 | 7/2002 | Cross et al. | |
| 2003/0080604 | A1 | 5/2003 | Vinegar et al. | |
| 2003/0085570 | A1 | 5/2003 | Ernst et al. | |
| 2003/0111223 | A1 | 6/2003 | Rouffignac et al. | |
| 2003/0131994 | A1 | 7/2003 | Vinegar et al. | |
| 2003/0131995 | A1 | 7/2003 | de Rouffignac et al. | |
| 2003/0178195 | A1 | 9/2003 | Agee et al. | |
| 2003/0183390 | A1 | 10/2003 | Veenstra et al. | |
| 2003/0192691 | A1* | 10/2003 | Vinegar et al. | 166/250.12 |
| 2003/0196788 | A1 | 10/2003 | Vinegar et al. | |
| 2003/0196789 | A1 | 10/2003 | Wellington | |
| 2003/0209348 | A1 | 11/2003 | Ward et al. | |
| 2003/0213594 | A1 | 11/2003 | Wellington et al. | |
| 2004/0020642 | A1 | 2/2004 | Vinegar et al. | |
| 2004/0140095 | A1 | 7/2004 | Vinegar et al. | |
| 2004/0198611 | A1 | 10/2004 | Atkinson | |
| 2004/0211557 | A1 | 10/2004 | Cole et al. | |
| 2005/0051327 | A1 | 3/2005 | Vinegar et al. | |
| 2005/0252656 | A1 | 11/2005 | Maguire | |
| 2005/0252832 | A1 | 11/2005 | Doyle et al. | |
| 2005/0252833 | A1 | 11/2005 | Doyle et al. | |
| 2005/0269077 | A1 | 12/2005 | Sandberg | |
| 2005/0269088 | A1 | 12/2005 | Vinegar et al. | |
| 2006/0021752 | A1 | 2/2006 | de St. Remey | |
| 2006/0100837 | A1 | 5/2006 | Symington et al. | |
| 2006/0199987 | A1* | 9/2006 | Kuechler et al. | 585/502 |
| 2006/0213657 | A1 | 9/2006 | Berchenko et al. | |
| 2007/0000662 | A1 | 1/2007 | Symington et al. | |
| 2007/0023186 | A1* | 2/2007 | Kaminsky et al. | 166/266 |
| 2007/0045265 | A1 | 3/2007 | McKinzie, II | |
| 2007/0045267 | A1 | 3/2007 | Vinegar et al. | |
| 2007/0084418 | A1 | 4/2007 | Gurevich | |
| 2007/0095537 | A1 | 5/2007 | Vinegar | |
| 2007/0102359 | A1 | 5/2007 | Lombardi et al. | |
| 2007/0131415 | A1 | 6/2007 | Vinegar et al. | |
| 2007/0137869 | A1 | 6/2007 | MacDougall et al. | |
| 2007/0144732 | A1 | 6/2007 | Kim et al. | |
| 2007/0209799 | A1 | 9/2007 | Vinegar et al. | |
| 2007/0246994 | A1* | 10/2007 | Kaminsky et al. | 299/3 |
| 2008/0087420 | A1 | 4/2008 | Kaminsky et al. | |
| 2008/0087421 | A1 | 4/2008 | Kaminsky | |
| 2008/0087426 | A1 | 4/2008 | Kaminsky | |
| 2008/0087427 | A1 | 4/2008 | Kaminsky et al. | |
| 2008/0087428 | A1* | 4/2008 | Symington et al. | 166/272.2 |
| 2008/0127632 | A1 | 6/2008 | Finkenrath | |
| 2008/0173443 | A1 | 7/2008 | Symington et al. | |
| 2008/0185145 | A1 | 8/2008 | Carney et al. | |
| 2008/0207970 | A1 | 8/2008 | Meurer et al. | |
| 2008/0230219 | A1 | 9/2008 | Kaminsky | |
| 2008/0271885 | A1 | 11/2008 | Kaminsky | |
| 2008/0283241 | A1 | 11/2008 | Kaminsky et al. | |
| 2008/0289819 | A1 | 11/2008 | Kaminsky et al. | |
| 2008/0290719 | A1 | 11/2008 | Kaminsky et al. | |
| 2009/0038795 | A1 | 2/2009 | Kaminsky et al. | |
| 2009/0050319 | A1 | 2/2009 | Kaminsky et al. | |
| 2009/0101346 | A1 | 4/2009 | Vinegar et al. | |
| 2009/0101348 | A1 | 4/2009 | Kaminsky | |
| 2009/0107679 | A1 | 4/2009 | Kaminsky | |
| 2009/0133935 | A1* | 5/2009 | Kinkead | 175/57 |
| 2009/0145598 | A1 | 6/2009 | Symington et al. | |
| 2009/0308608 | A1 | 12/2009 | Kaminsky et al. | |
| 2010/0078169 | A1 | 4/2010 | Symington et al. | |
| 2010/0089575 | A1 | 4/2010 | Kaminsky et al. | |
| 2010/0089585 | A1 | 4/2010 | Kaminsky | |
| 2010/0095742 | A1 | 4/2010 | Symington et al. | |
| 2010/0101793 | A1 | 4/2010 | Symington et al. | |
| 2010/0133143 | A1 | 6/2010 | Roes et al. | |
| 2010/0218946 | A1 | 9/2010 | Symington et al. | |
| 2010/0282460 | A1 | 11/2010 | Stone et al. | |
| 2010/0319909 | A1 | 12/2010 | Symington et al. | |
| 2011/0000221 | A1 | 1/2011 | Minta et al. | |
| 2011/0000671 | A1 | 1/2011 | Hershkowitz | |

FOREIGN PATENT DOCUMENTS

| | | |
|---|---|---|
| CA | 2560223 | 3/2007 |
| EP | 0387846 | 9/1990 |
| FR | EP 0866212 | 9/1998 |
| GB | 855408 | 11/1960 |
| GB | 1454324 | 11/1976 |
| GB | 1463444 | 2/1977 |
| GB | 1 478 880 | 7/1977 |
| GB | 1501310 | 2/1978 |
| GB | 1559948 | 1/1980 |
| GB | 1595082 | 8/1981 |
| WO | WO 82/01408 | 4/1982 |
| WO | WO 90/06480 | 6/1990 |
| WO | WO 99/67504 | 12/1999 |
| WO | WO 01/78914 | 10/2001 |
| WO | WO 01/081505 | 11/2001 |
| WO | WO 02/085821 | 10/2002 |
| WO | WO 2005/010320 | 2/2005 |
| WO | WO 2005/045192 | 5/2005 |
| WO | WO 2006/115943 | 11/2006 |
| WO | WO2007/033371 | 3/2007 |
| WO | WO2007/050445 | 5/2007 |
| WO | WO 2007/050479 | 5/2007 |
| WO | WO2010/047859 | 4/2010 |
| WO | WO2011/116148 | 9/2011 |

OTHER PUBLICATIONS

Allred, (1964) "Some Characteristic Properties of Colorado Oil Shale Which May Influence In Situ Processing," *Quarterly Colo. School Of Mines, 1st Symposium Oil Shale*, v.59. No. 3, pp. 47-75.

Asquith, G., et al., (2004) *Basic Well Log Analysis*, Second Ed., Chapter 1, pp. 1-20.

Ball, J.S., et al. (1949) "Composition of Colorado Shale-Oil Naphtha", *Industrial and Engineering Chemistry*, vol. 41, No. 3 pp. 581-587.

Barnes, A. L. et al. (1968) "Quarterly of the Colorado School of Mines" *Fifth Symposium on Oil Shale*, v. 63(4), Oct. 1968, pp. 827-852.

Bastow, T.P., (1998) Sedimentary Processes Involving Aromatic Hydrocarbons >>. Thesis (PhD in Applied Chemistry) Curtin University of Technology (Australia), December, p. 102.

Baugman, G. L. (1978) *Synthetic Fuels Data Handbook*, Second Edition, Cameron Engineers Inc.

Berry, K. L., et al. (1982) "Modified in situ retorting results of two field retorts", Gary, J. H., ed., 15th Oil Shale Symp., CSM, pp. 385-396.

Blanton, T. L. et al, (1999) "Stress Magnitudes from Logs: Effects of Tectonic Strains and Temperature", *SPE Reservoir Eval. & Eng.* 2, vol. 1, February pp. 62-68.

(56) References Cited

OTHER PUBLICATIONS

Boyer, H. E. et al. (1985) "Chapter 16: Heat-Resistant Materials," *Metals Handbook*, American Society for Metals, 16 pages.
Brandt, A. R., "*Converting Oil Shale to Liquid Fuels: Energy Inputs and Greenhouse Gas Emissions of the Shell in Situ Conversion Process*," Environ. Sci. Technol. 2008, 42, pp. 7489-7495.
Brandt, H. et al. (1965) "Stimulating Heavy Oil Reservoirs With Downhole Air-Gas Burners," *World Oil*, (Sep. 1965), pp. 91-95.
Bridges, J. E., et al. (1983) "The IITRI in situ fuel recovery process", *J. Microwave Power*, v. 18, pp. 3-14.
Burnham, A. K. et al. (1983) "High-Pressure Pyrolysis of Green River Oil Shale" in Geochemistry and Chemistry of Oil Shales: ACS Symposium Series.
Burwell, E. L. et al. (1970) "Shale Oil Recovery by In-Situ Retorting—A Pilot Study" Journal of Petroleum Engr., Dec. 1970, pp. 1520-1524.
Charlier, R. et al, (2002) "Numerical Simulation of the Coupled Behavior of Faults During the Depletion of a High-Pressure/High-Temperature Reservoir", *Society of Petroleum Engineers*, SPE 78199, pp. 1-12.
Chute, F. S., and Vermeulen, F. E., (1988) "Present and potential applications of electromagnetic heating in the in situ recovery of oil", AOSTRA J. Res., v. 4, pp. 19-33.
Chute, F. S. and Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.
Cipolla, C.L., et al. (1994), "Practical Application of in-situ Stress Profiles", *Society of Petroleum Engineers*, SPE 28607, pp. 487-499.
Cook, G. L. et al. (1968) "The Composition of Green River Shale Oils" United Nations Symposium of the Development and Utilization of Oil Shale Resources, 23 pgs.
Covell, J. R., et al. (1984) "Indirect in situ retorting of oil shale using the TREE process", Gary, J. H., ed., 17th Oil Shale Symposium Proceedings, Colorado School of Mines, pp. 46-58.
Cummins, J. J. et al. (1972) "Thermal Degradation of Green River Kerogen at 150 to 350C: Rate of Product Formation, Report of Investigation 7620," *US Bureau of Mines*, 1972.
Day, R. L., (1998) "Solution Mining of Colorado Nahcolite, Wyoming State Geological Survey Public Information Circular 40," *Proceedings of the First International Soda Ash Conference*, V.II (Rock Springs, Wyoming, Jun. 10-12) pp. 121-130.
DePriester, C. et al. (1963) "Well Stimulation by Downhole Gas-Air Burner," *Jml. Petro. Tech.*, (Dec. 1963), pp. 1297-1302.
Domine, F. et al. (2002) "Up to What Temperature is Petroleum Stable? New Insights from a 5200 Free Radical Reactions Model", *Organic Chemistry*, 33, pp. 1487-1499.
Dougan, P. M. et al. (1981) "BX In Situ Oil Shale Project," *Colorado School of Mines; Fourteenth Oil Shale Symposium Proceedings*, 1981, pp. 118-127.
Dougan, P. M. (1979) "The BX In Situ Oil Shale Project," *Chem. Engr. Progress*, pp. 81-84.
Duncan, D. C., (1967) "Geologic Setting of Oil Shale Deposits and World Prospects," *in Proceedings of the Seventh World Petroleum Congress*, v.3, Elsevier Publishing, pp. 659-667.
Dunks, G. et al. (1983) "Electrochemical Studies of Molten Sodium Carbonate," *Inorg. Chem.*, 22, pp. 2168-2177.
Dusseault, M.B. (1998) "Casing Shear: Causes, Cases, Cures", Society of Petroleum Engineers, SPE 48,864 pp. 337-349.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists*, Guidebook, pp. 111-122.
Fainberg, V. et al. (1998) "Integrated Oil Shale Processing Into Energy and Chemicals Using Combined-Cycle Technology," *Energy Sources*, v.20.6, Abstract, 1 page.
Farouq Ali, S. M., (1994), "Redeeming features of in situ combustion", DOE/NIPER *Symposium on In Situ Combustion Practices-Past, Present, and Future Application*, Tulsa, OK, Apr. 21-22, No. ISC 1, p. 3-8.
Fisher, S. T. (1980) "A Comparison of Eleven Processes for Production of Energy from the Solid Fossil Fuels of North America," *SPE* 9098, pp. 1-27.
Fox, J. P, (1980) "Water-related Impacts of In-Situ Oil Shale Processing," *California Univ., Berkeley, Lawrence Berkeley Lab*, Chapters 6-7.
Fredrich, J. T. et al, (1996) "Three-Dimensional Geomechanical Simulation of Reservoir Compaction and Implications for Well Failures in the Belridge Diatomite", *Society of Petroleum Engineers* SPE 36698, pp. 195-210.
Fredrich, J. T. et al, (2000) "Geomechanical Modeling of Reservoir Compaction, Surface Subsidence, and Casing Damage at the Belridge Diatomite Field", *SPE Reservoir Eval. & Eng.3*, vol. 4, August, pp. 348-359.
Fredrich, J. T. et al, (2003) "Stress Perturbations Adjacent to Salt Bodies in the Deepwater Gulf of Mexico", *Society of Petroleum Engineers* SPE 84554, pp. 1-14.
Frederiksen, S. et al, (2000) "A Numerical Dynamic Model for the Norwegian-Danish Basin", *Tectonophysics*, 343, 2001, pp. 165-183.
Freund, H. et al., (1989) "Low-Temperature Pyrolysis of Green River Kerogen", *The American Association of Petroleum Geologists Bulletin*, v. 73, No. 8 (August) pp. 1011-1017.
Gatens III, J. M. et al, (1990) "In-Situ Stress Tests and Acoustic Logs Determine Mechanical Properties and Stress Profiles in the Devonian Shales", *SPE Formation Evaluation* SPE 18523, pp. 248-254.
Garthoffner, E. H., (1998), "Combustion front and burned zone growth in successful California ISC projects", SPE 46244, pp. 1-11.
Greaves, M., et al. (1994) "In situ combustion (ISC) processes: 3D studies of vertical and horizontal wells", *Europe Comm. Heavy Oil Technology in a Wider Europe Symposium*, Berlin, Jun. 7-8, p. 89-112.
Hansen, K. S. et al, (1989) "Earth Stress Measurements in the South Belridge Oil Field, Kern County, California", *SPE Formation Evaluation*, Dec. pp. 541-549.
Hansen, K. S. et al, (1993) "Finite-Element Modeling of Depletion-Induced Reservoir Compaction and Surface Subsidence in the South Belridge Oil Field, California", SPE 26074, pp. 437-452.
Hansen, K. S. et al, (1995) "Modeling of Reservoir Compaction and Surface Subsidence at South Belridge", *SPE Production & Facilities*, August pp. 134-143.
Hardy, M. et al. (2003) "Solution Mining of Nahcolite at the American Soda Project, Piceance Creek, Colorado," *SME Annual Mtg.*, Feb. 24-26, Cincinnati, Ohio, Preprint 03-105.
Hardy, M., et al. (2003) "Solution Mining of Nahcolite at American Soda's Yankee Gulch Project," *Mining Engineering*, Oct. 2003, pp. 23-31.
Henderson, W, et al. (1968) "Thermal Alteration as a Contributory Process to the Genesis of Petroleum", *Nature* vol. 219, pp. 1012-1016.
Hilbert, L. B. et al, (1999) "Field-Scale and Wellbore Modeling of Compaction-Induced Casing Failures", *SPE Drill. & Completion*, 14(2), Jun. pp. 92-101.
Hill, G.R. et al. (1967) "The Characteristics of a Low Temperature In Situ Shale Oil," *4th Symposium on Oil Shale, Quarterly of the Colorado School of Mines*, v.62(3), pp. 641-656.
Hill, G. R. et al. (1967) "Direct Production of a Low Pour Point High Gravity Shale Oil", *I&EC Product Research and Development*, 6(1), March pp. 52-59.
Holditch, S. A., (1989) "Pretreatment Formation Evaluation", *Recent Advances in Hydraulic Fracturing*, SPE Monograph vol. 12, Chapter 2 (Henry L. Doherty Series), pp. 39-56.
Holmes, A. S. et al. (1982) "Process Improves Acid Gas Separation," Hydrocarbon Processing, pp. 131-136.
Holmes, A. S. et al. (1983) "Pilot Tests Prove Out Cryogenic Acid-Gas/Hydrocarbon Separation Processes," *Oil & Gas Journal*, pp. 85-91.
Humphrey, J. P. (1978) "Energy from in situ processing of Antrim oil shale", *DOE Report Fe-2346-29*.
Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.

(56) References Cited

OTHER PUBLICATIONS

Ireson, A. T. (1990) "Review of the Soluble Salt Process for In-Situ Recovery of Hydrocarbons from Oil Shale with Emphasis on Leaching and Possible Beneficiation," *23rd Colorado School of Mines Oil Shale Symposium* (Golden, Colorado), 152-161.
Jacobs, H. R. (1983) "Analysis of the Effectiveness of Steam Retorting of Oil Shale", *AIChE Symposium Series—Heat Transfer*—Seattle 1983 pp. 373-382.
Johnson, D. J. (1966) "Decomposition Studies of Oil Shale," *University of Utah*, May 1966.
Katz, D.L. et al. (1978) "*Predicting Phase Behavior of Condensate/Crude-Oil Systems Using Methane Interaction Coefficients, J. Petroleum Technology*", pp. 1649-1655.
Kenter, C. J. et al, (2004) "Geomechanics and 4D: Evaluation of Reservoir Characteristics from Timeshifts in the Overburden", *Gulf Rocks 2004, 6th North America Rock Mechanics Symposium (NARMS): Rock Mechanics Across Borders and Disciplines*, Houston, Texas, Jun. 5-9, ARMA/NARMS 04-627.
Kuo, M. C. T. et al (1979) "Inorganics leaching of spent shale from modified in situ processing," J. H. Gary (ed.) *Twelfth Oil Shale Symposium Proceedings*, Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences*, 10(3), pp. 107-122.
Lekas, M. A. et al. (1991) "Initial evaluation of fracturing oil shale with propellants for in situ retorting—Phase 2", *DOE Report DOE/MC/11076-3064*.
Le Pourhiet, L. et al, (2003) "Initial Crustal Thickness Geometry Controls on the Extension in a Back Arc Domain: Case of the Gulf of Corinth", *Tectonics*, vol. 22, No. 4, pp. 6-1-6-14.
Lundquist, L. (1951) "Refining of Swedish Shale Oil", *Oil Shale Cannel Coal Conference*, vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics*, 373, pp. 25-37.
Miknis, F.P, et al (1985) "Isothermal Decomposition of Colorado Oil Shale", DOE/FE/60177-2288 (DE87009043) May 1985.
Mohammed, Y.A., et al (2001) "A Mathematical Algorithm for Modeling Geomechanical Rock Properties of the Khuff and PreKhuff Reservoirs in Ghawar Field", *Society of Petroleum Engineers* SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004, 6th North America Rock Mechanics Symposium (NARMS): Rock Mechanics Across Borders and Disciplines*, Houston, Texas, Jun. 5-9, ARMA/NARMS 04-639, pp. 1-7.
Moschovidis, Z. (1989) "Interwell Communication by Concurrent Fracturing—a New Stimulation Technique", *Joum. of Canadian Petro. Tech*. 28(5), pp. 42-48.
Motzfeldt, K. (1954) "The Thermal Decomposition of Sodium Carbonate by the Effusion Method," *Jml. Phys. Chem*., v. LIX, pp. 139-147.
Mut, Stephen (2005) "The Potential of Oil Shale," *Shell Oil Presentation at National Academies, Trends in Oil Supply Demand*, in Washington, DC, Oct. 20-21, 2005, 11 pages.
Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.
Newkirk, A. E. et al. (1958) "Drying and Decomposition of Sodium Carbonate," *Anal. Chem*., 30(5), pp. 982-984.
Nielsen, K. R., (1995) "Colorado Nahcolite: A Low Cost Source of Sodium Chemicals," *7th Annual Canadian Conference on Markets for Industrial Minerals*, (Vancouver, Canada, Oct. 17-18) pp. 1-9.
Nottenburg, R.N. et al. (1979) "Temperature and stress dependence of electrical and mechanical properties of Green River oil shale," *Fuel*, 58, pp. 144-148.
Nowacki, P. (ed.), (1981) *Oil Shale Technical Handbook*, Noyes Data Corp.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Persoff, P. et al. (1979) "Control strategies for abandoned in situ oil shale retorts," J. H. Gary (ed.), *12th Oil Shale Symposium Proceedings*, Colorado School of Mines, Golden, CO., Apr. 18-20, pp. 72-80.
Peters, G., (1990) "The Beneficiation of Oil Shale by the Solution Mining of Nahcolite," *23rd Colorado School of Mines Oil Shale Symposium* (Golden, CO) pp. 142-151.
Plischke, B., (1994) "Finite Element Analysis of Compaction and Subsidence—Experience Gained from Several Chalk Fields", *Society of Petroleum Engineers*, SPE 28129, 1994, pp. 795-802.
Prats, M. et al. (1975) "The Thermal Conductivity and Diffusivity of Green River Oil Shales", *Journal of Petroleum Technology*, pp. 97-106, Jan. 1975.
Prats, M., et al. (1977) "Soluble-Salt Processes for In-Situ Recovery of Hydrocarbons from Oil Shale," *Journal of Petrol. Technol*., pp. 1078-1088.
Rajeshwar, K. et al. (1979) "Review: Thermophysical Properties of Oil Shales", *Journal of Materials Science*, v.14, pp. 2025-2052.
Ramey, M. et al. (2004) "The History and Performance of Vertical Well Solution Mining of Nahcolite ($NaHCO_3$) in the Piceance Basin, Northwestern, Colorado, USA," *Solution Mining Research Institute: Fall 2004 Technical Meeting* (Berlin, Germany).
Reade Advanced Materials; 2006 About.com Electrical resistivity of materials. [Retrieved on Oct. 15, 2009] Retrieved from internet: URL: http://www.reade.com/Particle%5FBriefings/elec%5Fres.html. Entire Document.
Riva, D. et al. (1998) "Suncor down under: the Stuart Oil Shale Project", Annual Meeting of the *Canadian Inst. of Mining, Metallurgy, and Petroleum*, Montreal, May 3-7.
Rupprecht, R. (1979) "Application of the Ground-Freezing Method to Penetrate a Sequence of Water-Bearing and Dry Formations—Three Construction Cases," *Engineering Geology*, 13, pp. 541-546.
Ruzicka, D.J. et al. (1987) "Modified Method Measures Bromine Number of Heavy Fuel Oils", *Oil & Gas Journal*, 85(31), Aug. 3, pp. 48-50.
Salamonsson, G. (1951) "The Ljungstrom In Situ Method for Shale-Oil Recovery," *2nd Oil Shale and Cannel Coal Conference*, 2, Glasgow, Scotland, Inst. of Petrol., London, pp. 260-280.
Sahu, D. et al. (1988) "Effect of Benzene and Thiophene on Rate of Coke Formation During Naphtha Pyrolysis", *Canadian Journ. of Chem. Eng*., 66, Oct. pp. 808-816.
Sandberg, C. R. et al. (1962) "In-Situ Recovery of Oil from Oil Shale—A Review and Summary of Field and Laboratory Studies," RR62.039FR, Nov. 1962.
Sierra, R. et al. (2001) "Promising Progress in Field Application of Reservoir Electrical Heating Methods," *SPE 69709*, SPE Int'l Thermal Operations and Heavy Oil Symposium, Venezuela, Mar. 2001, 17 pages.
Siskin, M. et al. (1995) "Detailed Structural Characterization of the Organic Material in Rundel Ramsay Crossing and Green River Oil Shales," *Kluwer Academic Publishers*, pp. 143-158.
Smart, K. J. et al, (2004) "Integrated Structural Analysis and Geomechanical Modeling: an Aid to Reservoir Exploration and Development", *Gulf Rocks 2004, 6th North America Rock Mechanics Symposium (NARMS): Rock Mechanics Across Borders and Disciplines*, Houston, Texas, Jun. 5-9, ARMA/NARMS 04-470.
Smith, F. M. (1966) "A Down-hole Burner—Versatile Tool for Well Heating," *25th Tech. Conf. on Petroleum Production*, Pennsylvania State Univ., pp. 275-285.
Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.
Stevens, A. L., and Zahradnik, R. L. (1983) "Results from the simultaneous processing of modified in situ retorts 7& 8", Gary, J. H., ed., *16th Oil Shale Symp*., CSM, p. 267-280.
Stoss, K. et al. (1979) "Uses and Limitations of Ground Freezing With Liquid Nitrogen," *Engineering Geology*, 13, pp. 485-494.

(56) References Cited

OTHER PUBLICATIONS

Symington, W.A., et al (2006) ExxonMobil's electrofrac process for in situ oil shale conversion 26th Oil Shale Symposium, Colorado School of Mines.
Syunyaev, Z.I. et al. (1965) "Change in the Resistivity of Petroleum Coke on Calcination," Chemistry and Technology of Fuels and Oils, 1(4), pp. 292-295.
Templeton, C. C. (1978) "Pressure-Temperature Relationship for Decomposition of Sodium Bicarbonate from 200 to 600° F," *J. of Chem. And Eng. Data*, 23(1), pp. 7-8.
Thomas, A. M. (1963) "Thermal Decomposition of Sodium Carbonate Solutions," *J. of Chem. And Eng. Data*, 8(1), pp. 51-54.
Thomas, G. W. (1964) "A Simplified Model of Conduction Heating in Systems of Limited Permeability," *Soc.Pet. Engineering Journal*, Dec. 1964, pp. 335-344.
Thomas, G. W. (1966) "Some Effects of Overburden Pressure on Oil Shale During Underground Retorting," *Society of Petroleum Engineers Journal*, pp. 1-8, Mar. 1966.
Tihen, S. S. Et al. (1967) "Thermal Conductivity and Thermal Diffusivity of Green River Oil Shale," *Thermal Conductivity: Proceedings of the Seventh Conference* (Nov. 13-16, 1967), *NBS Special Publication* 302, pp. 529-535, 1968.
Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.
Tisot, P. R. et al. (1971) "Structural Deformation of Green River Oil Shale as It Relates to In Situ Retorting," *US Bureau of Mines Report of Investigations 7576*, 1971.
Tisot, P. R. (1975) "Structural Response of Propped Fractures in Green River Oil Shale as It Relates to Underground Retorting," *US Bureau of Mines Report of Investigations 8021*.
Tissot, B. P., and Welte, D. H. (1984) *Petroleum Formation and Occurrence*, New York, Springer-Verlag, p. 160-174, 175-198 and 254-266.
Tissot, B. P., and Welte, D. H. (1984) *Petroleum Formation and Occurrence*, New York, Springer-Verlag, p. 267-289 and 470-492.
Turta, A., (1994), "In situ combustion- from pilot to commercial application", *DOE/NIPER Symposium on In Situ Combustion Practices-Past, Present, and Future Application*, Tulsa, OK, Apr. 21-22, No. ISC 3, p. 15-39.
Tyner, C. E. et al. (1982) "Sandia/Geokinetics Retort 23: a horizontal in situ retorting experiment", Gary, J. H., ed., *15th Oil Shale Symp.*, CSM, p. 370-384.
Tzanco, E. T., et al. (1990), "Laboratory Combustion Behavior of Countess B Light Oil", *Petroleum Soc. of CIM and SPE*, Calgary, Jun. 10-13, No. CIM/SPE 90-63, p. 63.1-63.16.
Veatch, Jr. R.W. and Martinez, S.J., et al. (1990) "Hydraulic Fracturing: Reprint Series No. 28", *Soc. of Petroleum Engineers* SPE 14085, Part I, Overview.
Warpinski, N.R., (1989) "Elastic and Viscoelastic Calculations of Stresses in Sedimentary Basins", *SPE Formation Evaluation*, vol. 4, pp. 522-530.
Yen, T. F. et al. (1976) *Oil Shale*, Amsterdam, Elsevier, p. 216-267.
Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.
Oil & Gas Journal, 1998, "Aussie oil shale project moves to Stage 2", Oct. 26, p. 42.
"Encyclopedia of Chemical Technology" (4th ed.), *Alkali and Chlorine Products*, pp. 1025-1039 (1998).
EP Search Report dated Dec. 29, 2003 (RS 110243, Corresponding to US Pat 7,331,385).
EP Search Report dated Mar. 17, 2004 (RS 110686, Corresponding to U.S. Patent 7,441,603).
EP Search Report, Supplementary dated Apr. 10, 2007 (EP 04 77 9878 Corresponding to U.S. Patent 7,441,603).
EP Search Report dated Apr. 29, 2005 (RS 112183, Corresponding to U.S. Appl. No. 11/250,804, Published as US 2006/0100837 on May 11, 2008).
EP Search Report dated Jun. 2, 2006 (RS113865, corresponding to U.S. Appl. No. 11/726,651).
EP Search Report dated Feb. 16, 2007 (RS 114808, Corresponding to U.S. Appl. No. 11/973,746, Published as US 2008/0087420 on May 17, 2008).
EP Search Report dated Feb. 16, 2007 (RS 114804, Corresponding to U.S. Appl. No. 11/973,750, Published as US 2008/0087427 on Apr. 17, 2008).
EP Search Report dated Mar. 21, 2007 (RS 114890, Corresponding to U.S. Patent 7,516,787).
EP Search Report dated Feb. 16, 2007 (RS 114807, Corresponding to U.S. Patent 7,669,657).
EP Search Report dated Nov. 13, 2007 (RS 115479, Corresponding to U.S. Appl. No. 12/148,414).
EP Search Report dated Aug. 29, 2007 (No. RS115553, Corresponding to U.S. Appl. No. 12/148,388).
EP Search Report dated Jul. 4, 2007 ( RS 115341 Corresponding to U.S. Appl. No. 12/074,899).
EP Search Report dated Jul. 5, 2007 (RS 115432 Corresponding to U.S. Appl. No. 12/075,087).
EP Search Report dated Mar. 12, 2009 (EP 08 00 3956,-Corresponding to U.S. Appl. No. 12/271,521).
EP Search Report dated Aug. 29, 2007 (RS 1155554, Corresponding to U.S. Appl. No. 12/154,238).
EP Search Report dated Aug. 28, 2007 (RS 1155555, Corresponding to U.S. Appl. No. 12/154,256).
International Search Report for PCT/US01/09247 Jun. 20, 2001.
International Search Report for PCT/US04/11508, Jan. 5, 2005.
International Search Report for PCT/US08/88045, Feb. 12, 2009.
International Search Report for PCT/USO4/24947 Mar. 10, 2005.
International Search Report for PCT/US07/07133, Jan. 4, 2008.
International Search Report for PCT/US07/21673 Jun. 24, 2008.
International Search Report for PCT/US07/21668 Apr. 29, 2008.
International Search Report for PCT/US07/21666 Apr. 4, 2008.
International Search Report for PCT/US07/21669, Apr. 29, 2008.
International Search Report for PCT/US07/21660 Apr. 4, 2008.
International Search Report for PCT/US07/021968, May 14, 2008.
International Search Report for PCT/US07/021968, May 21, 2008.
International Search Report for PCT/US08/005008, Aug. 29, 2008.
International Search Report for PCT/US08/05056, Aug. 25, 2008.
International Search Report for PCT/US/08/003069, Jun. 25, 2008.
International Search Report for PCT/US08/003043, Jul. 2, 2008.
International Search Report for PCT/US08/083815, Mar. 20, 2009.
International Search Report for PCT/US08/006462 Sep. 22, 2008.
International Search Report for PCT/US08/006463 Aug. 22, 2008.
International Search Report for PCT/US07/21645 Apr. 21, 2008.
International Search Report for PCT/US09/037419 Jul. 7, 2009.
International Search Report for PCT/US09/055403, Oct. 22, 2009.
International Search Report for PCT/US10/20342 Feb. 26, 2010.
International Search Report for PCT/US10/031910 Aug. 3, 2010.
International Search Report for PCT/US10/057204 Jan. 27, 2011.
U.S. Appl. No. 12/630,636 Office Action mailed Oct. 27, 2010.
U.S. Appl. No. 11/250,804 Office Action mailed Oct. 16, 2008.
U.S. Appl. No. 11/250,804 Office Action mailed Jun. 11, 2009.
U.S. Appl. No. 11/973,746 Office Action mailed Jun. 25, 2009.
U.S. Appl. No. 11/973,746 Office Action mailed Nov. 8, 2010.
U.S. Appl. No. 11/973,750 Office Action mailed Dec. 4, 2008.
U.S. Appl. No. 11/973,750 Office Action mailed Jul. 22, 2009.
U.S. Appl. No. 12/638,630 Office Action mailed Mar. 16, 2011.
U.S. Appl. No. 12/712,904 Office Action mailed Nov. 10, 2010.
U.S. Appl. No. 12/148,414 Office Action mailed May 19, 2010.
U.S. Appl. No. 12/148,414 Office Action mailed Oct. 22, 2010.
U.S. Appl. No. 12/148,388 Office Action mailed Jun. 10, 2010.
U.S. Appl. No. 12/148,388 Office Action mailed Nov. 19, 2010.
U.S. Appl. No. 12/074,899 Office Action mailed Dec. 16, 2009.
U.S. Appl. No. 12/074,899 Office Action mailed Jul. 26, 2010.
U.S. Appl. No. 12/074,899 Office Action mailed Jan. 4, 2011.
U.S. Appl. No. 12/075,087 Office Action mailed Oct. 12, 2010.
U.S. Appl. No. 12/075,087 Office Action mailed Mar. 7, 2011.
U.S. Appl. No. 12/271,521 Office Action mailed Nov. 2, 2010.
U.S. Appl. No. 11/973,898 Office Action mailed May 6, 2010.
U.S. Appl. No. 11/973,898 Office Action mailed Dec. 20, 2010.
U.S. Appl. No. 12/405,901 Office Action mailed Feb. 14, 2011.

(56) References Cited

OTHER PUBLICATIONS

U.S. Appl. No. 12/154,238 Office Action mailed Apr. 22, 2011.
U.S. Appl. No. 12/154,256 Office Action mailed May 9, 2011.
U.S. Appl. No. 12/148,414 Office Action mailed May 17, 2011.
U.S. Appl. No. 12/443,680 Office Action mailed Jun. 23, 2011.
U.S. Pat No. 6,918,444—Office Action mailed Sep. 16, 2004.
US Pat No. 7,331,385—Office Action mailed Jul. 12, 2007.
U.S. Pat No. 7,631,691—Office Action mailed Mar. 18, 2009.
U.S. Pat No. 7,441,603—Office Action mailed Feb. 25, 2008.
U.S. Pat No. 7,857,056—Office Action mailed Mar. 19, 2010.
US Pat No. 7,516,785—Office Action mailed Apr. 2, 2008.
US Pat No. 7,516,787—Office Action mailed Apr. 3, 2008.
U.S. Pat No. 7,647,972—Office Action mailed May 19, 2009.
U.S. Pat No. 7,647,971—Office Action mailed May 21, 2009.
U.S. Pat No. 7,669,657—Office Action mailed Jun. 26, 2008.
U.S. Pat No. 7,669,657—Office Action mailed Dec. 15, 2008.
U.S. Pat No. 7,669,657—Office Action mailed Sep. 15, 2009.
US Pat No. 7,644,993—Office Action mailed Jun. 24, 2009.

* cited by examiner

OLEFIN REDUCTION FOR IN SITU PYROLYSIS OIL GENERATION

CROSS-REFERENCE TO RELATED APPLICATION

This application claims the priority benefit of U.S. Provisional Patent Application 61/378,274 filed 30 Aug. 2010 entitled OLEFIN REDUCTION FOR IN SITU PYROLYSIS OIL GENERATION, the entirety of which is incorporated by reference herein.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD

The present invention relates to the field of hydrocarbon recovery from subsurface formations. More specifically, the present invention relates to the in situ recovery of hydrocarbon fluids from organic-rich rock formations including, for example, oil shale formations, coal formations and tar sands formations. The present invention also relates to methods for reducing olefin content of hydrocarbons fluids.

GENERAL DISCUSSION OF TECHNOLOGY

Certain geological formations are known to contain an organic matter known as "kerogen." Kerogen is a solid, carbonaceous material. When kerogen is imbedded in rock formations, the mixture is referred to as oil shale. This is true whether or not the mineral is, in fact, technically shale, that is, a rock formed primarily from compacted clay.

Kerogen is subject to decomposing upon exposure to heat over a period of time. Upon heating, kerogen molecularly decomposes into smaller molecules to produce oil, gas, and carbonaceous coke. Small amounts of water may also be generated. The oil, gas and water fluids become mobile within the rock matrix, while the carbonaceous coke remains essentially immobile.

Oil shale formations are found in various areas worldwide, including the United States. Such formations are notably found in Wyoming, Colorado, and Utah. Oil shale formations tend to reside at relatively shallow depths and are often characterized by limited permeability. Some consider oil shale formations to be hydrocarbon deposits which have not yet experienced the years of heat and pressure thought to be required to create conventional oil and gas reserves.

The decomposition rate of kerogen to produce mobile hydrocarbons is temperature dependent. Temperatures generally in excess of 270° C. (518° F.) over the course of at least several months may be required for substantial conversion. At higher temperatures, substantial conversion may occur within shorter times. When kerogen is heated to the necessary temperature, chemical reactions break the larger molecules forming the solid kerogen into smaller molecules of oil and gas. The thermal conversion process is referred to as pyrolysis, or retorting.

Attempts have been made for many years to extract oil from oil shale formations. Near-surface oil shales have been mined and retorted at the surface for over a century. In 1862, James Young began processing Scottish oil shales. The industry lasted for about 100 years. Commercial oil shale retorting through surface mining has been conducted in other countries as well. Such countries include Australia, Brazil, China, Estonia, France, Russia, South Africa, Spain, Jordan and Sweden. However, the practice has been mostly discontinued in recent years as it has proved to be uneconomical or because of environmental constraints on spent shale disposal. (See T. F. Yen, and G. V. Chilingarian, "*Oil Shale*," Amsterdam, Elsevier, p. 292, the entire disclosure of which is incorporated herein by reference.) Further, surface retorting requires mining of the oil shale, which limits that particular application to very shallow formations.

In the United States, the existence of oil shale deposits in northwestern Colorado has been known since the early 1900's. Several research projects have been conducted in this area from time to time. Most research on oil shale production was carried out in the latter half of the 1900's. The majority of this research was on shale oil geology, geochemistry, and retorting in surface facilities.

In 1947, U.S. Pat. No. 2,732,195 issued to Fredrik Ljungstrom. That patent, entitled "Method of Treating Oil Shale and Recovery of Oil and Other Mineral Products Therefrom," proposed the application of heat at high temperatures to the oil shale formation in situ. The purpose of such in situ heating was to distill hydrocarbons and to produce them to the surface. The '195 Ljungstrom patent is incorporated herein in its entirety by reference.

Ljungstrom coined the phrase "heat supply channels" to describe bore holes drilled into the formation. The bore holes received an electrical heat conductor which transferred heat to the surrounding oil shale. Thus, the heat supply channels served as early heat injection wells. The electrical heating elements in the heat injection wells were placed within sand or cement or other heat-conductive material to permit the heat injection wells to transmit heat into the surrounding oil shale. According to Ljungstrom, the subsurface "aggregate" was heated to between 500° C. and 1,000° C. in some applications.

Along with the heat injection wells, fluid producing wells were completed in near proximity to the heat injection wells. As kerogen was pyrolyzed upon heat conduction into the aggregate or rock matrix, the pyrolysis oil and gas would be recovered through the adjacent production wells.

Ljungstrom applied his approach of thermal conduction from heated wellbores through the Swedish Shale Oil Company. A full-scale plant was developed that operated from 1944 into the 1950's. (See G. Salamonsson, "The Ljungstrom In Situ Method for Shale-Oil Recovery," $2^{nd}$ Oil Shale and Cannel Coal Conference, v. 2, Glasgow, Scotland, Institute of Petroleum, London, pp. 260-280 (1951), the entire disclosure of which is incorporated herein by reference.)

A number of in situ conversion methods have since been proposed over the years. These methods generally involve the injection of heat and/or solvent into a subsurface oil shale formation. For example, U.S. Pat. No. 3,241,611, entitled "Recovery of Petroleum Products From Oil Shale," proposed the injection of pressurized hot natural gas into an oil shale formation. The '611 patent issued in 1966 to J. L. Dougan and is incorporated herein by reference. Dougan suggested that the natural gas be injected at a temperature of 924° F.

Another method is found in U.S. Pat. No. 3,400,762 entitled "In Situ Thermal Recovery of Oil From an Oil Shale." This patent issued in 1968 to D. W. Peacock. The '762 patent proposed the injection of superheated steam.

Other methods of heating have also been proposed. Such methods include electric resistive heating and dielectric heating applied to a reservoir volume. U.S. Pat. No. 4,140,180, assigned to the ITT Research Institute in Chicago, Ill., discussed heating methods using electrical energy or "excitation" in the radio frequency (RF) range. The use of electrical resistors in which an electrical current is passed through a resistive material which dissipates the electrical energy as heat is distinguished from dielectric heating in which a high-frequency oscillating electric current induces electrical currents in nearby materials and causes the materials to heat. A review of applications of electrical heating methods for heavy oil reservoirs is given by R. Sierra and S. M. Farouq Ali, "Promising Progress in Field Application of Reservoir Electrical Heating Methods," SPE Paper No 69,709 (Mar. 12-14, 2001).

Heating may also be in the form of oxidant injection to support in situ combustion. Examples include, in numerical order, U.S. Pat. Nos. 3,109,482; 3,225,829; 3,241,615; 3,254,721; 3,127,936; 3,095,031; 5,255,742; and U.S. Pat. No. 5,899,269. Such patents typically use a downhole burner. Downhole burners have advantages over electrical heating methods due to the reduced infrastructure cost. In this respect, there is no need for an expensive electrical power plant and distribution system. Moreover, there is increased thermal efficiency because the energy losses inherently experienced during electrical power generation are avoided.

In some instances, artificial permeability has been created in the matrix to aid the movement of pyrolyzed fluids upon heating. Permeability generation methods include mining, rubblization, hydraulic fracturing (see U.S. Pat. No. 3,468,376 to M. L. Slusser and U.S. Pat. No. 3,513,914 to J. V. Vogel), explosive fracturing (see U.S. Pat. No. 1,422,204 to W. W. Hoover, et al.), heat fracturing (see U.S. Pat. No. 3,284,281 to R. W. Thomas), and steam fracturing (see U.S. Pat. No. 2,952,450 to H. Purre).

It has also been proposed to run alternating current or radio frequency electrical energy between stacked conductive fractures or electrodes in the same well in order to heat a subterranean formation. See U.S. Pat. No. 3,149,672 titled "Method and Apparatus for Electrical Heating of Oil-Bearing Formations;" U.S. Pat. No. 3,620,300 titled "Method and Apparatus for Electrically Heating a Subsurface Formation;" U.S. Pat. No. 4,401,162 titled "In Situ Oil Shale Process;" and U.S. Pat. No. 4,705,108 titled "Method for In Situ Heating of Hydrocarbonaceous Formations." U.S. Pat. No. 3,642,066 titled "Electrical Method and Apparatus for the Recovery of Oil," provides a description of resistive heating within a subterranean formation by running alternating current between different wells. Others have described methods to create an effective electrode in a wellbore. See U.S. Pat. No. 4,567,945 titled "Electrode Well Method and Apparatus;" and U.S. Pat. No. 5,620,049 titled "Method for Increasing the Production of Petroleum From a Subterranean Formation Penetrated by a Wellbore."

U.S. Pat. No. 3,137,347 titled "In Situ Electrolinking of Oil Shale," describes a method by which electric current is flowed through a fracture connecting two wells to get electric flow started in the bulk of the surrounding formation. Heating of the formation ostensibly occurs primarily due to the bulk electrical resistance of the formation. F. S. Chute and F. E. Vermeulen, *Present and Potential Applications of Electromagnetic Heating in the In Situ Recovery of Oil*, AOSTRA J. Res., v. 4, p. 19-33 (1988) describes a heavy-oil pilot test where "electric preheat" was used to flow electric current between two wells to lower viscosity and create communication channels between wells for follow-up with a steam flood.

Additional history behind oil shale retorting and shale oil recovery can be found in co-owned U.S. Pat. No. 7,331,385 entitled "Methods of Treating a Subterranean Formation to Convert Organic Matter into Producible Hydrocarbons," and in U.S. Pat. No. 7,441,603 entitled "Hydrocarbon Recovery from Impermeable Oil Shales." The Backgrounds and technical disclosures of these two patents are incorporated herein by reference.

As noted, the in situ heating of solid organic matter to high temperatures (e.g., greater than 270° C.) leads to a thermal breakdown of hydrocarbon molecules. Examples of rock containing solid organic matter include oil shale, bitumen, and coal. The breakdown of the organic matter occurs over the course of months, and leads to the conversion of solid hydrocarbons into liquid, gas, and solids (coke). The generated fluids are referred to as "pyrolysis oil" and "pyrolysis gas." Some water may also be generated.

It is known that oil generated from rapid pyrolysis tends to have a higher olefin content than naturally-occurring petroleum oils. An olefin is any unsaturated hydrocarbon containing one or more pairs of carbon atoms linked by a double bond. Olefins, especially those having multiple double bonds, have a tendency to polymerize into large molecules which form precipitates. These precipitates are often referred to as gums and sludges. Precipitates can cause pipeline transportation problems and tank storage problems. Alkenes are a subclass of olefins which are open chain molecules. Diolefins are olefinic molecules containing two double bonds.

The rapid thermal breakdown of organic matter into liquid and gas results in a large fraction of resulting molecules being understaturated with hydrogen, causing the molecules to be olefinic. See, e.g., J. S. Ball, et al., "Composition of Colorado Shale-Oil Naphtha," *Industrial and Engineering Chemistry,* 41 (3), pp. 581-587 (March 1949) and L. Lundquist, "Refining of Swedish Shale Oil", Oil Shale Cannel Coal Conference, Vol./Issue: 2, pp. 621-627 (1951). Accordingly, pyrolysis oils sometimes require chemical hydrogenation if they are to be refined into fuels such as gasoline. Various refinery processes are known to perform chemical hydrogenation at the surface. However, hydrogenation adds capital cost, especially if done at a remote field site to permit pipeline transportation to a main refinery.

It is desirable to hydrogenate olefinic molecules in situ to convert the olefinic molecules into a saturated form. U.S. Pat. Publ. No. 2009/0133935 entitled "Olefin Metathesis for Kerogen Upgrading" recently proposed a method for chemically-upgrading shale-bound kerogen in situ. The kerogen is contacted with a quantity of alkene species in the presence of an olefin metathesis catalyst. A catalyzed metathetical reaction is said to occur between the shale-bound kerogen and the alkene species. Smaller kerogen-derived molecular species are formed and produced to the surface.

U.S. Pat. No. 6,918,442, entitled "In Situ Thermal Processing of an Oil Shale Formation in a Reducing Environment," claims a method of heating an oil shale formation in situ. The method comprises heating a first section of the formation to produce a mixture from the formation; heating a second section of the formation; controlling the heat such that an average heating rate of the first or the second section is less than about 1° C. per day in a pyrolysis temperature range of about 270° C. to about 400° C.; and re-circulating a portion of the produced mixture from the first section into the second section of the formation to provide a reducing environment within the second section of the formation. The '442 patent also claims a process that includes producing hydrogen and condensable hydrocarbons from the formation; and hydrogenating a portion of the produced condensable hydrocarbons with at least a portion of the produced hydrogen. The patent further claims providing hydrogen ($H_2$) to the first or second section to hydrogenate hydrocarbons within the first or second section; and heating a portion of the first or second section with heat from hydrogenation. It is not entirely clear what the patent means by "heat from hydrogenation." Be that as it may, a need remains for an improved method of producing hydrocarbon fluids that reduces olefin content in situ without re-circulating a chemical or a hydrogenating mixture to create the reducing environment.

Although methods exist for reducing olefin content via surface processing and in situ by injecting reactive chemicals, a need exists for an improved method of producing hydrocarbon fluids that reduces olefin content in situ without relying on surface processing or obtaining reactive chemicals for injection.

SUMMARY

The methods described herein have various benefits in improving the recovery of hydrocarbon fluids from an organic-rich rock formation. In various embodiments, such benefits may include increased production of hydrocarbon fluids, and improved quality of pyrolysis oil, such as during a shale oil production operation.

A method for producing hydrocarbon fluids from an organic-rich rock formation to a surface facility is first provided. The organic-rich rock formation comprises formation hydrocarbons such as solid hydrocarbons or heavy hydrocarbons. In one aspect, the organic-rich rock formation represents a tar sand formation or a coal bed. In another aspect, the organic-rich rock formation is an oil shale formation. The formation may have an initial permeability of less than about 10 millidarcies.

The method includes providing a plurality of in situ heat sources. Selected heat sources are configured to generate heat within a first zone of the organic-rich rock formation. The first zone may constitute a volume having an areal extent of at least 1,000 $m^2$. Alternatively, the first zone may constitute a volume having an areal extent of at least 4,000 $m^2$.

The method also includes heating the organic-rich rock formation in situ within the first zone. The purpose of heating is to cause pyrolysis or mobilization of formation hydrocarbons. Preferably, the organic-rich rock formation is heated to a temperature of at least 200° C. Heating of the organic-rich rock formation continues so that heat moves away from the respective heat sources and through the first zone. Where the formation is an oil shale formation, the first zone is preferably heated to a temperature of at least 270° C.

The method also includes providing a plurality of production wells adjacent selected heat sources. The production wells are located within the first zone. The method then comprises producing hydrocarbon fluids having a first composition from the first zone through the plurality of production wells within the first zone.

The method additionally includes heating the organic-rich rock formation in situ within a second zone. Heating of the organic-rich rock formation continues so that heat moves away from heat sources within the second zone so that a temperature of at least 200° C. is created within the organic-rich rock formation proximal the heat sources within the second zone. Where the formation is an oil shale formation, the first zone is preferably heated to a temperature of at least 270° C.

The method also includes producing hydrocarbon fluids from the second zone. Production takes place through the plurality of production wells within the first zone. In this way, hydrocarbon fluids produced from the second zone contact coke within a rock matrix in the first zone. These hydrocarbon fluids thus have a second composition.

The second zone may be adjacent to the first zone. In this instance, flow communication between the second zone and the first zone is provided by porous flow through the rock matrix. Alternatively, the second zone may be apart or remotely located from the first zone. In this instance, a tubular body is used to provide fluid communication between the second zone and the first zone. In either instance, the method then includes producing hydrocarbon fluids from the second zone through the plurality of production wells within the first zone.

In accordance with the methods herein, the composition of the hydrocarbon fluids produced from the first and second zones together has a lower average olefinic content than the hydrocarbon fluids produced from the first zone alone. Stated another way, the second composition of hydrocarbon fluids has a lower average olefinic content than the first composition of hydrocarbon fluids. Olefinic content may refer to olefinic content of a liquid distillate cut with an atmospheric bubble point less than about 330° C. In another aspect, lower olefinic content reflects diolefinic content.

A method for hydrogenating pyrolysis oil from an oil shale formation is also provided herein. In one aspect, the method includes providing a plurality of in situ heat sources. Each heat source is configured to generate heat within a first zone of the oil shale formation so as to pyrolyze solid hydrocarbons into pyrolysis oil.

The method also includes heating the oil shale formation in situ in the first zone. The purpose of heating is to cause pyrolysis of formation hydrocarbons. Preferably, the oil shale formation is heated to a temperature of at least 270° C. Heating of the oil shale formation continues so that heat moves away from the respective heat sources and through the first zone.

The method also includes providing a plurality of production wells adjacent selected heat sources. The production wells are located within the first zone. The method then comprises producing hydrocarbon fluids from the first zone through the plurality of production wells within the first zone.

The method additionally includes heating the organic-rich rock formation in situ within a second zone. Heating of the organic-rich rock formation continues so that heat moves away from heat sources within the second zone so that a temperature of at least 270° C. is created within the organic-rich rock formation proximal the heat sources within the second zone.

The method also includes producing hydrocarbon fluids from the second zone. Production takes place through the plurality of production wells within the first zone. In this way, hydrocarbon fluids produced from the second zone contact solid carbon material remaining within a rock matrix in the first zone. This serves to hydrogenate pyrolysis oil and reduce olefinic content. In accordance with the method herein, the composition of the hydrocarbon fluids produced from the first and second zones together has a lower average olefinic content than the hydrocarbon fluids produced from the first zone alone.

In one aspect, the method also includes injecting a gas into the organic-rich rock formation in the second zone. The injected gas is preferably substantially non-reactive in the organic-rich rock formation. The injected gas may be, for example, (i) nitrogen, (ii) carbon dioxide, (iii) methane, or (iv) combinations thereof. Alternatively, the injected gas may be hydrocarbon gas produced from the production wells. Beneficially, injecting the gas increases the formation pressure in the second zone, helping to move pyrolysis oil to the first zone. Injecting the gas also increases the value of effective thermal diffusivity within the second zone, helping to provide more uniform in situ conversion.

BRIEF DESCRIPTION OF THE DRAWINGS

So that the present inventions can be better understood, certain drawings, charts, graphs and flow charts are appended hereto. It is to be noted, however, that the drawings illustrate only selected embodiments of the inventions and are therefore not to be considered limiting of scope, for the inventions may admit to other equally effective embodiments and applications.

FIG. 3A shows a hydrocarbon development area. Here, the respective first and second zones are arranged in a checkerboard pattern.

FIG. 3B shows a hydrocarbon development area. The respective first and second zones are again arranged in a checker-board pattern. Here, selected heat injection wells in the second zone are converted to gas injection wells.

FIG. 3C shows a hydrocarbon development area. Here, the areal extent of the second zone is significantly larger than the areal extent of the first zone.

FIG. 3D shows a hydrocarbon development area. Here, the respective first and second zones are arranged in parallel rows.

FIG. 4A shows the hydrocarbon development area wherein the first zone undergoes pyrolysis and production first.

FIG. 4B shows the hydrocarbon development area of FIG. 4A, with the second zone now undergoing pyrolysis and production. Produced pyrolysis oil and pyrolysis gas are being transported to the first zone for injection and subsequent production.

DETAILED DESCRIPTION OF CERTAIN EMBODIMENTS

Definitions

Figure 1:
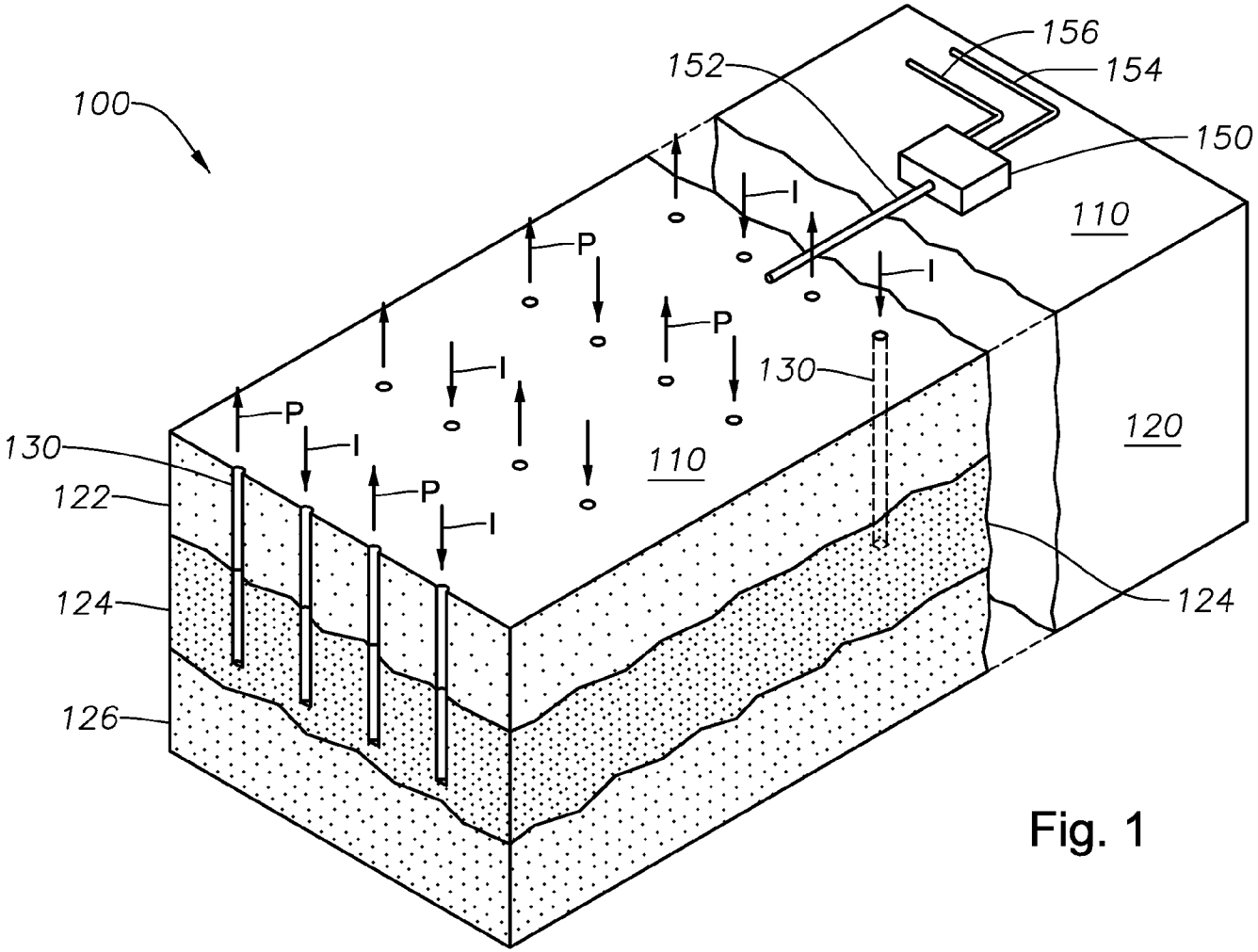
FIG. 1 is a cross-sectional isometric view of an illustrative hydrocarbon development area. The hydrocarbon development area includes a subsurface formation that defines an organic-rich rock matrix.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, pyrolyzed shale oil, natural gas, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, and combinations of liquids and solids.

As used herein, the term "gas" refers to a fluid that is in its vapor phase at 1 atm and 15° C.

As used herein, the term "condensable hydrocarbons" means those hydrocarbons that condense to a liquid at about 15° C. and one atmosphere absolute pressure. Condensable hydrocarbons may include a mixture of hydrocarbons having carbon numbers greater than 4.

As used herein, the term "non-condensable" means those chemical species that do not condense to a liquid at about 15° C. and one atmosphere absolute pressure. Non-condensable species may include non-condensable hydrocarbons and non-condensable non-hydrocarbon species such as, for example, carbon dioxide, hydrogen, carbon monoxide, hydrogen sulfide, and nitrogen. Non-condensable hydrocarbons may include hydrocarbons having carbon numbers less than 5.

The term "liquefied natural gas" or "LNG," is natural gas generally known to include a high percentage of methane, but optionally other elements and/or compounds including, but not limited to, ethane, propane, butane, carbon dioxide, nitrogen, helium, hydrogen sulfide, or combinations thereof) that has been processed to remove one or more components (for instance, helium) or impurities (for instance, water, hydrogen sulfide, and/or heavy hydrocarbons) and then condensed into a liquid at almost atmospheric pressure by cooling.

As used herein, the term "oil" refers to a hydrocarbon fluid containing primarily a mixture of condensable hydrocarbons.

As used herein, the term "heavy hydrocarbons" refers to hydrocarbon fluids that are highly viscous at ambient conditions (15° C. and 1 atm pressure). Heavy hydrocarbons may include highly viscous hydrocarbon fluids such as heavy oil, tar, bitumen, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20 degrees. Heavy oil, for example, generally has an API gravity of about 10 to 20 degrees, whereas tar generally has an API gravity below about 10 degrees. The viscosity of heavy hydrocarbons is generally greater than about 100 centipoise at 15° C.

As used herein, the term "solid hydrocarbons" refers to any hydrocarbon material that is found naturally in substantially solid form at formation conditions. Non-limiting examples include kerogen, coal, shungites, asphaltites, and natural mineral waxes.

As used herein, the term "formation hydrocarbons" refers to both heavy hydrocarbons and solid hydrocarbons that are contained in an organic-rich rock formation. Formation hydrocarbons may be, but are not limited to, kerogen, oil shale, coal, bitumen, tar, natural mineral waxes, and asphaltites.

As used herein, the term "tar" refers to a viscous hydrocarbon that generally has a viscosity greater than about 10,000 centipoise at 15° C. The specific gravity of tar generally is greater than 1.000. Tar may have an API gravity less than 10 degrees. "Tar sands" refers to a formation that has tar in it.

As used herein, the term "kerogen" refers to a solid, insoluble hydrocarbon that principally contains carbon, hydrogen, nitrogen, oxygen, and/or sulfur.

As used herein, the term "bitumen" refers to a non-crystalline solid or viscous hydrocarbon material that is substantially soluble in carbon disulfide.

As used herein, the term "subsurface" refers to geologic strata occurring below the earth's surface.

As used herein, the term "hydrocarbon-bearing formation" refers to any formation that contains more than trace amounts of hydrocarbons. For example, a hydrocarbon-bearing formation may include portions that contain hydrocarbons at a level of greater than 5 percent by volume. The hydrocarbons located in a hydrocarbon-bearing formation may include, for example, oil, natural gas, heavy hydrocarbons, and solid hydrocarbons.

As used herein, the term "organic-rich rock" refers to any rock matrix holding solid hydrocarbons and/or heavy hydrocarbons. Rock matrices may include, but are not limited to, sedimentary rocks, shales, siltstones, sands, silicilytes, carbonates, and diatomites. Organic-rich rock may contain kerogen.

As used herein, the term "organic-rich rock formation" refers to any formation containing organic-rich rock. Organic-rich rock formations include, for example, oil shale formations, coal formations, and tar sands formations.

As used herein, the term "formation" refers to any definable subsurface region. The formation may contain one or more hydrocarbon-containing layers, one or more non-hydrocarbon containing layers, an overburden, and/or an underburden of any geologic formation. An "overburden" and/or an "underburden" is geological material above or below the formation of interest.

An "overburden" or "underburden" may include one or more different types of substantially impermeable materials. For example, overburden and/or underburden may include sandstone, shale, mudstone, or wet/tight carbonate (i.e., an impermeable carbonate without hydrocarbons). An overburden and/or an underburden may include a hydrocarbon-containing layer that is relatively impermeable. In some cases, the overburden and/or underburden may be permeable.

As used herein, the term "pyrolysis" refers to the breaking of chemical bonds through the application of heat. For example, pyrolysis may include transforming a compound into one or more other substances by heat alone or by heat in combination with an oxidant. Pyrolysis may include modifying the nature of the compound by addition of hydrogen atoms which may be obtained from molecular hydrogen, water, carbon dioxide, or carbon monoxide. Heat may be transferred to a section of the formation to cause pyrolysis.

As used herein, the term "water-soluble minerals" refers to minerals that are soluble in water. Water-soluble minerals include, for example, nahcolite (sodium bicarbonate), soda ash (sodium carbonate), dawsonite ($NaAl(CO_3)(OH)_2$), or combinations thereof. Substantial solubility may require heated water and/or a non-neutral pH solution.

As used herein, the term "formation water-soluble minerals" refers to water-soluble minerals that are found naturally in a formation.

As used herein, the term "thickness" of a layer refers to the distance between the upper and lower boundaries of a cross section of a layer, wherein the distance is measured normal to the average tilt of the cross section.

As used herein, the term "thermal fracture" refers to fractures created in a formation caused directly or indirectly by expansion or contraction of a portion of the formation and/or fluids within the formation, which in turn is caused by increasing/decreasing the temperature of the formation and/or fluids within the formation, and/or by increasing/decreasing a pressure of fluids within the formation due to heating. Thermal fractures may propagate into or form in neighboring regions significantly cooler than the heated zone.

As used herein, the term "hydraulic fracture" refers to a fracture at least partially propagated into a formation, wherein the fracture is created through injection of pressurized fluids into the formation. While the term "hydraulic fracture" is used, the inventions herein are not limited to use in hydraulic fractures. The invention is suitable for use in any fracture created in any manner considered to be suitable by one skilled in the art. The fracture may be artificially held open by injection of a proppant material. Hydraulic fractures may be substantially horizontal in orientation, substantially vertical in orientation, or oriented along any other plane.

As used herein, the term "coke" means a carbonaceous solid derived from a process of cracking hydrocarbons. The term "coke" includes the solid residue remaining from the pyrolysis of solid hydrocarbons.

As used herein, the term "wellbore" refers to a hole in the subsurface made by drilling or insertion of a conduit into the subsurface. A wellbore may makeup part, or all, of a well. A wellbore may have a substantially circular cross section, or other cross-sectional shape (e.g., an oval, a square, a rectangle, a triangle, or other regular or irregular shapes). Wellbores may be cased, cased and cemented, or open-hole. A wellbore may be vertical, horizontal, or any angle between vertical and horizontal (a deviated wellbore). A vertical wellbore may comprise a non-vertical component. As used herein, the term "well", when referring to an opening in the formation, may be used interchangeably with the term "wellbore."

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

FIG. 1 is a cross-sectional perspective view of an illustrative hydrocarbon development area 100. The hydrocarbon development area 100 has a surface 110. Preferably, the surface 110 is an earth surface on land. However, the surface 110 may be an earth surface under a body of water, such as a lake, an estuary, a bay, or an ocean.

The hydrocarbon development area 100 also has a subsurface 120. The subsurface 120 includes various formations, including one or more near-surface formations 122, a hydrocarbon-bearing formation 124, and one or more non-hydrocarbon formations 126. The near surface formations 122 represent an overburden, while the non-hydrocarbon formations 126 represent an underburden. Both the one or more near-surface formations 122 and the non-hydrocarbon formations 126 will typically have various strata with different mineralogies therein.

The hydrocarbon-bearing formation 124 defines a rock matrix made up of layers of organic-rich rock. The hydrocarbon development area 100 is for the purpose of producing hydrocarbon fluids from the hydrocarbon-bearing formation 124. The illustrative hydrocarbon-bearing formation 124 contains organic-rich rock (such as, for example, kerogen) and possibly valuable water-soluble minerals (such as, for example, nahcolite).

It is understood that the representative formation 124 may be any organic-rich rock formation, including a rock matrix containing coal or tar sands, for example. In addition, the rock matrix making up the formation 124 may be permeable, semi-permeable or non-permeable. The present inventions are particularly advantageous in shale oil development areas initially having very limited or effectively no fluid permeability. For example, initial permeability may be less than 10 millidarcies.

The hydrocarbon-bearing formation 124 may be selected for development based on various factors. One such factor is the thickness of organic-rich rock layers or sections within the formation 124. As discussed more fully in FIG. 2, the hydrocarbon-bearing formation 124 is made up of a series of layers having different thicknesses and different organic grades.

Greater pay zone thickness may indicate a greater potential volumetric production of hydrocarbon fluids. Each of the hydrocarbon-containing layers within the formation 124 may have a thickness that varies depending on, for example, conditions under which the organic-rich rock layer was formed. Therefore, an organic-rich rock formation such as hydrocarbon-bearing formation 124 will typically be selected for treatment if that formation includes at least one hydrocarbon-containing section having a thickness sufficient for economical production of hydrocarbon fluids.

An organic-rich rock formation such as formation 124 may also be chosen if the thickness of several layers that are closely spaced together is sufficient for economical production of produced fluids. For example, an in situ conversion process for formation hydrocarbons may include selecting and treating a layer within an organic-rich rock formation having a thickness of greater than about 5 meters, 10 meters, 50 meters, or even 100 meters. In this manner, heat losses (as a fraction of total injected heat) to layers formed above and below an organic-rich rock formation may be less than such heat losses from a thin layer of formation hydrocarbons. A process as described herein, however, may also include incidentally selecting and treating layers that may include layers substantially free of formation hydrocarbons or thin layers of formation hydrocarbons.

The richness of one or more sections in the hydrocarbon-bearing formation 124 may also be considered. For an oil shale formation, richness is generally a function of the kerogen content. The kerogen content of the oil shale formation may be ascertained from outcrop or core samples using a variety of data. Such data may include Total Organic Carbon content, hydrogen index, and modified Fischer Assay analyses. The Fischer Assay is a standard method which involves heating a sample of a hydrocarbon-containing-layer to approximately 500° C. in one hour, collecting fluids produced from the heated sample, and quantifying the amount of fluids produced.

Richness may depend on many factors including the conditions under which the formation hydrocarbon-containing-layer was formed, an amount of formation hydrocarbons in the layer, and/or a composition of formation hydrocarbons in the layer. A thin and rich formation hydrocarbon layer may be able to produce significantly more valuable hydrocarbons than a much thicker but less-rich formation hydrocarbon layer. Of course, producing hydrocarbons from a formation that is both thick and rich is desirable.

Subsurface permeability may also be assessed via rock samples, outcrops, or studies of ground water flow. Furthermore, the connectivity of the development area to ground water sources may be assessed. An organic-rich rock formation such as formation 124 may be chosen for development based on the permeability or porosity of the formation matrix even if the thickness of the formation 124 is relatively low. Reciprocally, an organic-rich rock formation may be rejected if there appears to be vertical continuity with groundwater.

Other factors known to petroleum engineers may be taken into consideration when selecting a formation for development. Such factors include depth of the perceived pay zone, continuity of thickness, and other factors. For instance, the organic content or richness of rock within a formation will also effect eventual volumetric production.

In order to access the hydrocarbon-bearing formation 124 and recover natural resources therefrom, a plurality of wellbores 130 is formed. Each of the wellbores 130 in FIG. 1 has either an up arrow or a down arrow associated with it. The up arrows indicate that the associated wellbore 130 is a production well. Some of these up arrows are indicated with a "P." The production wells "P" produce hydrocarbon fluids from the hydrocarbon-bearing formation 124 to the surface 110. Reciprocally, the down arrows indicate that the associated wellbore 130 is a heat injection well, or a heater well. Some of these down arrows are indicated with an "I." The heat injection wells "I" inject heat into the hydrocarbon-bearing formation 124. Heat may be injected into the formation in a number of ways known in the art including: hot fluid injection, circulation of hot fluid within the wellbore, use of downhole burners, and use of downhole electric heaters or heat sources.

The purpose for heating the organic-rich rock in the formation 124 is to pyrolyze at least a portion of solid formation hydrocarbons to create hydrocarbon fluids. The organic-rich rock in the formation 124 is heated to a temperature sufficient to pyrolyze at least a portion of the oil shale (or other solid hydrocarbons) in order to convert the kerogen (or other organic-rich rock) to hydrocarbon fluids. Alternatively, the purpose for heating is to mobilize heavy hydrocarbons by reducing viscosity, enabling them to flow. In any event, the resulting hydrocarbon liquids and gases may be refined into products which resemble common commercial petroleum products. Such liquid products include transportation fuels such as diesel, jet fuel and naphtha. Generated gases include light alkanes, light alkenes, $H_2$, $CO_2$, CO, and $NH_3$.

The solid formation hydrocarbons may be pyrolyzed in situ by raising the organic-rich rock in the formation 124, (or heated zones within the formation), to a pyrolyzation temperature. In certain embodiments, the temperature of the formation 124 may be slowly raised through the pyrolysis temperature range. For example, an in situ conversion process may include heating at least a portion of the formation 124 to raise the average temperature of one or more sections above about 270° C. at a rate less than a selected amount (e.g., about 10° C., 5° C.; 3° C., 1° C., or 0.5° C.) per day. In a further embodiment, the portion may be heated such that an average temperature of one or more selected zones over a one month period is between about 375° C. and 400° C.

The hydrocarbon-bearing formation 124 may be heated such that a temperature within the formation reaches (at least) an initial pyrolyzation temperature, that is, a temperature at the lower end of the temperature range where pyrolyzation begins to occur. The pyrolysis temperature range may vary depending on the types of formation hydrocarbons within the formation, the heating methodology, and the distribution of heating sources. For example, a pyrolysis temperature range may include temperatures between about 270° C. and 800° C. Alternatively, the bulk of the target zone of the formation 124 may be heated to between about 300° C. and 600° C. In an alternative embodiment, a pyrolysis temperature range may include temperatures between about 270° C. and 500° C.

Conversion of oil shale into hydrocarbon fluids will create permeability in rock matrices in the formation 124 that were originally substantially impermeable. For example, permeability may increase due to formation of thermal fractures within a heated portion caused by application of heat. As the temperature of the heated formation 124 increases, water may be removed due to vaporization. The vaporized water may escape and/or be removed from the formation 124 through the production wells "P." In addition, permeability of the formation 124 may also increase as a result of production of hydrocarbon fluids generated from pyrolysis of at least some of the formation hydrocarbons on a macroscopic scale.

In one embodiment, the organic-rich rock in the formation 124 has an initial total permeability less than 10 millidarcies, alternatively less than 0.1 or even 0.01 millidarcies, before heating the hydrocarbon-bearing formation 124. Permeability of a selected zone within the heated portion of the formation 124 may rapidly increase while the selected zone is heated by conduction. For example, pyrolyzing at least a portion of an organic-rich rock formation may increase permeability within a selected zone to about 1 millidarcy, alternatively, greater than about 10 millidarcies, 50 millidarcies, 100 millidarcies, 1 Darcy, 10 Darcies, 20 Darcies, or 50 Darcies. Therefore, a permeability of a selected zone or section may increase by a factor of more than about 10, 100, 1,000, 10,000, or 100,000.

It is understood that petroleum engineers will develop a strategy for the best completion depth and arrangement for the wellbores 130 depending upon anticipated reservoir characteristics, economic constraints, and work scheduling constraints. In addition, engineering staff will determine what wellbores "I" should be formed for initial formation heating.

Subsequent to the pyrolysis process, some of the heat injection wells "I" may be converted to water injection wells. This is particularly advantageous for heat injection wells "I" on the periphery of the hydrocarbon development area 100. The injection of water may control the migration of pyrolyzed fluids from the hydrocarbon development area 100.

In the illustrative hydrocarbon development area 100, the wellbores 130 are arranged in rows. The production wells "P" are in rows, and the heat injection wells "I" are in adjacent rows. This is referred to in the industry as a "line drive" arrangement. However, other geometric arrangements may be used such as a 5-spot arrangement. The inventions disclosed herein are not limited to the arrangement of production wells "P" and heat injection wells "I" within a particular zone unless so stated in the claims.

In the arrangement of FIG. 1, each of the wellbores 130 is completed in the hydrocarbon-bearing formation 124. The completions may be either open-hole or cased-hole. The well completions for the production wells "P" may also include propped or unpropped hydraulic fractures emanating therefrom as a result of a hydraulic fracturing operation.

The various wellbores 130 are presented as having been completed substantially vertically. However, it is understood that some or all of the wellbores 130, particularly for the production wells "P," could deviate into an obtuse or even horizontal orientation.

In the view of FIG. 1, only eight wellbores 130 are shown for the heat injection wells "I." Likewise, only eight wellbores 130 are shown for the production wells "P." However, it is understood that in an oil shale development project, numerous additional wellbores 130 will be drilled. In addition, separate wellbores (not shown) may optionally be formed for water injection, freezing, and sensing or data collection.

The production wells "P" and the heat injection wells "I" are also arranged at a pre-determined spacing. In some embodiments, a well spacing of 15 to 25 feet is provided for the various wellbores 130. The claims disclosed below are not limited to the spacing of the production wells "P" or the heat injection wells "I" unless otherwise stated. In general, the wellbores 130 may be from about 10 feet up to even about 300 feet in separation.

Typically, the wellbores 130 are completed at shallow depths. Completion depths may range from 200 to 5,000 feet at true vertical depth. In some embodiments, the oil shale formation targeted for in situ retorting is at a depth greater than 200 feet below the surface, or alternatively 400 feet below the surface. Alternatively, conversion and production occur at depths between 500 and 2,500 feet.

As suggested briefly above, the wellbores 130 may be selected for certain initial functions before being converted to water injection wells and oil production wells and/or water-soluble mineral solution production wells. In one aspect, the wellbores 130 are drilled to serve two, three, or four different purposes in designated sequences. Suitable tools and equipment may be sequentially run into and removed from the wellbores 130 to serve the various purposes.

A production fluids processing facility 150 is also shown schematically in FIG. 1. The processing facility 150 is designed to receive fluids produced from the organic-rich rock of the formation 124 through one or more pipelines or flow lines 152. The fluid processing facility 150 may include equipment suitable for receiving and separating oil, gas, and water produced from the heated formation 124. The fluids processing facility 150 may further include equipment for separating out dissolved water-soluble minerals and/or migratory contaminant species, including, for example, dissolved organic contaminants, metal contaminants, or ionic contaminants in the produced water recovered from the hydrocarbon-bearing formation 124.

FIG. 1 shows two exit lines 154, 156. The exit lines 154, 156 carry fluids from the fluids processing facility 150. Exit line 154 carries pyrolysis oil, while exit line 156 carries pyrolysis gas. It is understood that a third line (not shown) will also typically be present for carrying separated water. The water may be treated and, optionally, re-injected into the hydrocarbon-bearing formation 124. The water may be used to maintain reservoir pressure, or may be circulated through the hydrocarbon-bearing formation 124 at the conclusion of the production process as part of a subsurface reclamation project.

Figure 2:
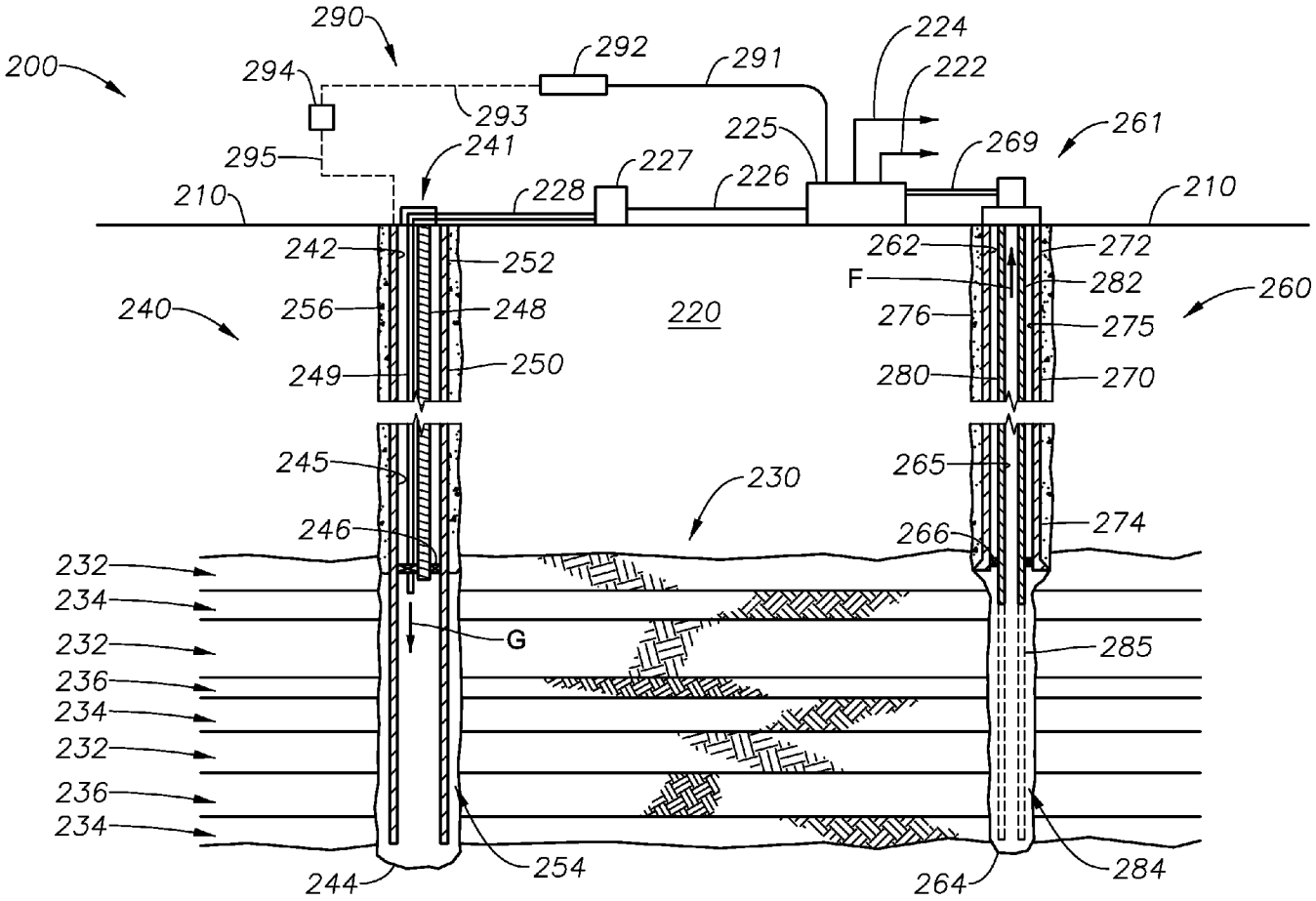
FIG. 2 is a cross-sectional view of an illustrative oil shale formation that is undergoing pyrolysis and production. A representative heater well is shown, along with a representative production well.

FIG. 2 is a cross-sectional view of a portion of a hydrocarbon development area 200. The hydrocarbon development area 200 includes a surface 210 and a subsurface 220. The hydrocarbon development area is for the purpose of producing hydrocarbon fluids from an organic-rich rock formation 230 within the subsurface 220.

It is first noted that the organic-rich rock formation 230 has various strata. These are denoted as 232, 234, and 236. Strata 232 are representative of sections of the organic-rich rock formation 230 that are "lean," that is, have a low kerogen content. Strata 236 are representative of sections of the organic-rich rock formation 230 that are "rich," that is, have a high kerogen content. Strata 234 are representative of sections of the organic-rich rock formation 230 that are less rich in kerogen content, but still offer producible hydrocarbons in economic quantities. In other words, strata 234 have a richness range that is intermediate the upper range of lean strata 232 and the lower range of rich strata 236.

In FIG. 2, two adjacent wells are provided. These are shown at 240 and 260. Well 240 is an illustrative heat injection well, while well 260 is an illustrative production well. Heat injection well 240 has an upper end 242 and a lower end 244. Similarly, production well 260 has an upper end 262 and a lower end 264. The heat injection well 240 has a bore at 245, while the production well 260 has a bore at 265.

A well head 241 is provided for the heat injection well 240. Similarly, a well head 261 is provided for the production well 260. The well heads 241, 261 isolate the bores 245, 265 from the surface 210. The well heads 241, 261 are shown schematically; however, it is understood that the well heads 241, 261 will include one or more flow control valves.

Referring specifically to the heat injection well 240, the heat injection well 240 is lined with a string of casing 250. The string of casing 250 is a surface casing. Because oil shale formations tend to be shallow, only the single string of casing 250 will typically be required. However, it is understood that a second string of casing (not shown) may also be employed.

The string of casing 250 has an upper end 252 at the surface 210. The upper end 252 is in sealed fluid communication with a lower fracture valve or some other valve as is common for a well tree. The string of casing 250 also has a lower end 254. Preferably, the lower end 254 extends to the lower portion of the heat injection well 240.

The heat injection well 240 provides heat to the organic-rich rock formation 230. In one aspect, the heat is generated through resistive heat. To this end, the string of casing 250 is fabricated from steel or other electrically conductive material. Preferably, the upper portion 252 of the string of casing 250 is fabricated from a highly conductive material, and is insulated down to the organic-rich rock formation 230.

In the arrangement of FIG. 2, the string of casing 250 for the heat injection well 240 is part of an electrical circuit. An electric current is delivered to the string of casing 250 through an insulated electric line 295. Current then runs through the string of casing 250. The bottom portion 254 of the string of casing 250 is fabricated to generate resistive heat. The heat radiates from the bottom portion 254 of the well 240 and into the organic-rich rock formation 230. Heat causes the organic-rich rock in the formation 230 to reach a pyrolysis temperature, which in turn converts solid formation hydrocarbons or, possibly, heavy hydrocarbons, into flowable hydrocarbon fluids.

The electric current returns to the surface 210 through an electrically conductive member 248. In the arrangement of FIG. 2, the electrically conductive member 248 is a metal bar. However, the electrically conductive member 248 could alternatively be a wire, a rod, a tubular body, or other elongated metal device.

The electrically conductive member 248 is preferably insulated except at its lowest end. This prevents the current from shorting with the string of casing 250. Non-conductive centralizers (not shown) may be utilized along the length of the electrically conductive member 248 to further prevent contact with the string of casing 250.

In order to deliver current from the string of casing 250 to the electrically conductive member 248, a conductive centralizer is used. This is shown at 246. The conductive centralizer 246 is preferably placed just above the organic-rich rock formation 230. However, in an alternate arrangement the electrically conductive member 248 extends to the bottom 244 of the heat injection well 240, and the conductive centralizer 246 is placed near the bottom 254 of the casing 250.

The string of casing 250 has a cement sheath 256 placed around at least the upper end 242 of the well 240. This serves to isolate strata and any aquitards in the subsurface 210. At its lower end 244, the heat injection well 240 is completed as an open hole. The open hole extends substantially along the depth of the organic-rich rock formation 230.

In order to generate resistive heat, the electric current is sent downward through the string of casing 250, which serves as an electrically conductive first member. The current reaches the electrically conductive centralizer 246 (or other conductive member) and then passes to the electrically conductive member 248, which serves as an electrically conductive second member. The current then returns to the surface 210 to form the electrical circuit. The current also travels to the bottom portion 254 of the string of casing 250. As the current passes through the bottom portion 254 of the string of casing 250, heat is resistively generated. The resistivity of pipe forming the casing 250 is higher in the bottom portion 254 of the string of casing 250 than in the upper portion 252.

It is noted that electrical current may be passed in the opposite direction, that is, down through the electrically conductive member 248 and back up the string of casing 250. However, in this direction current may not travel as effectively down to the bottom portion 254 of the string of casing 250 and along the organic-rich rock formation 230.

It is also noted that other arrangements for providing electrical communication between the string of casing 250 and the electrically conductive member 248 may be employed. For example, electrically conductive granular material may be placed in the bore 245 of the well 240 along the organic-rich rock formation 230. Calcined petroleum coke is an example of a suitable conductive material. The granular material may be designed to have a resistivity that is significantly higher than resistivities of the electrically conductive first 250 and second 248 members. In this arrangement, the granular material would be filled to the bottom of the electrically conductive second member 248 to provide electrical communication between the electrically conductive first 250 and second 248 members.

In a related arrangement, an electrically conductive granular material may be placed in the lower end of adjacent wellbores, with the granular material being in electrical communication with electrically conductive members within the respective wellbores. A passage is formed in the subsurface between a first wellbore and a second wellbore. The passage is located at least partially within the subsurface in or near a stratum to be heated. In one aspect, the passage comprises one or more connecting fractures. The electrically conductive granular material is additionally placed within the fractures to provide electrical communication between the electrically conductive members of the adjacent wellbores.

In this arrangement, a current is passed between the electrically conductive members. Passing current through the electrically conductive members and the intermediate granular material causes resistive heat to be generated primarily from the electrically conductive members within the wellbores. This arrangement for generating heat is disclosed and described in U.S. Patent Publ. No. 2008/0271885 published on Nov. 6, 2008. This publication is entitled "Granular Electrical Connections for In Situ Formation Heating." FIGS. 30A and 31 and associated text are incorporated herein by reference.

U.S. Patent Publ. No. 2008/0271885 also describes certain embodiments wherein the passage between adjacent wellbores is a drilled passage. In this manner, the lower ends of wellbores are in fluid communication. The conductive granular material is then poured or otherwise placed in the passage such that granular material resides in both the wellbores and the drilled passage. Passing current through the electrically conductive members and the intermediate granular material again causes resistive heat to be generated primarily from the electrically conductive members within the wellbores. This arrangement for generating heat is disclosed and described in connection with FIGS. 30B, 32, and 33 and associated text, which are incorporated herein by reference.

In another heating arrangement, an electrically resistive heater may be formed by providing electrically conductive piping or other members within individual wellbores. More specifically, an electrically conductive first member and an electrically conductive second member may be disposed in each wellbore. A conductive granular material is then placed between the conductive members within the individual wellbores to provide electrical communication. The granular material may be mixed with materials of greater or lower conductivity to adjust the bulk resistivity. Materials with greater conductivity may include metal filings or shot; materials with lower conductivity may include quartz sand, ceramic particles, clays, gravel, or cement.

A current is passed through the conductive members and the granular material. Passing current through the conductive members and the intermediate granular material causes resistive heat to be generated primarily from the electrically resistive granular material within the respective wellbores. In one embodiment, the electrically conductive granular material is interspersed with slugs of highly conductive granular material in regions where minimal or no heating is desired. This heater well arrangement is disclosed and described in U.S. Patent Publ. No. 2008/0230219 published on Sep. 25, 2008. This publication is titled "Resistive Heater for In Situ Formation Heating." FIGS. 30A, 31A, 32 and 33 and associated text are incorporated herein by reference.

In still another aspect, an electrically resistive heater may be formed by providing electrically conductive members within adjacent wellbores. The adjacent wellbores are connected at lower ends through drilled passageways. A conductive granular material is then poured or otherwise placed in the passage ways such that the granular material is located in the respective passageways and at least partially in each of the corresponding wellbores. A current is passed between the wellbores through the granular material. Passing current through the pipes and the intermediate granular material causes resistive heat to be generated through the subsurface primarily from the electrically resistive granular material. Such an arrangement is also disclosed and described in U.S. Patent Publ. No. 2008/0230219, particularly in connection with FIGS. 34A and 34B. FIGS. 34A and 34B and associated text are likewise incorporated herein by reference.

Co-owned U.S. Pat. Publ. No. 2010/0101793 is also instructive. That application was filed on Aug. 28, 2009 and is entitled "Electrically Conductive Methods for Heating a Subsurface Formation to Convert Organic Matter into Hydrocarbon Fluids." The application teaches the use of two or more materials placed within an organic-rich rock formation and having different bulk resistivities. An electrical current is passed through the materials in the formation to generate resistive heat. The materials provide for resistive heat without creating hot spots near the wellbores. This patent application is incorporated herein by reference in its entirety.

International patent publication WO 2005/045192 teaches a particularly intriguing option for heating that employs the circulation of a heated fluid within an oil shale formation. In the process of WO 2005/045192 supercritical heated naphtha may be circulated through fractures in the formation. This means that the oil shale is heated by circulating a dense, hot hydrocarbon vapor through sets of closely-spaced hydraulic fractures. In one aspect, the fractures are horizontally formed and conventionally propped. Fracture temperatures of 320° to 400° C. are maintained for up to five to ten years. Vaporized naphtha may be the preferred heating medium due to its high volumetric heat capacity, ready availability and relatively low degradation rate at the heating temperature. In the WO 2005/045192 process, as the kerogen matures, fluid pressure will drive the generated oil to the heated fractures, where it will be produced with the cycling hydrocarbon vapor.

Regardless of the heating technique, the development area 200 includes a surface processing facility 225. The surface processing facility 225 serves the primary purpose of processing production fluids received from the organic-rich rock formation 230. Production fluids are generated as a result of pyrolysis taking place in the formation 230. A flow of production fluids to the surface processing facility 225 is indicated in the production well 260 at arrow "F." The surface processing facility 225 separates fluid components and delivers a pyrolysis oil stream 222 and a pyrolysis gas stream 224 for commercial sale. Additional processing of the gas from gas stream 224 may take place to remove acid gases. A separate line (not shown) removes separated water from the surface processing facility 225 for possible further treatment.

The surface processing facility 225 reserves a portion of the separated gas as a gas turbine feed stream 291. The gas turbine feed stream 291 provides fuel for a gas turbine 292. The gas turbine 292, in turn, is part of an electrical power plant 290. In the gas turbine 292, the fuel is combined with an oxidant and ignited, causing the gas turbine 292 in the power plant 290 to turn and to generate electricity. An electrical current is shown at line 293.

The electrical current 293 is delivered to a transformer 294. The transformer 294 steps down the voltage, for example 6,600 V, and delivers a stepped down electric current through electric line 295. This is the electric current that is delivered to the heat injection well 240. The heat injection well 240 then provides electrically resistive heat into the organic-rich rock formation 230.

A heat front (not shown) is created in the organic-rich rock formation 230. The heat front heats the organic-rich rock formation 230 to a level sufficient to pyrolyze solid hydrocarbons into hydrocarbon fluids. In the case of an oil shale formation, that level is at least about 270° C.

As an option for the heat injection well 240, additional heat may be pumped into the bore 245 through a heat injection line 249. The heat may be in the form of steam. More preferably, the heat is in the form of heated gas such as air, nitrogen, or oxygen. A heated gas is delivered to the bottom portion 254 of the casing 250 as indicated at arrow "G."

To provide for heated gas, another slip stream of pyrolysis gas 226 may be taken from the fluids processing facility 225. The pyrolysis gas 226 is mixed with air in a combustion generator 227, and ignited. An additional non-reactive gas may be added, and a heated gas stream is released through line 228. The heated gas stream in line 228 is delivered to the well head 241, and into the heat injection line 249.

The heat injection line 249 delivers the heated gas "G" down to the organic-rich rock formation 230. The injection of heated gas "G" not only provides further heat to the formation 230 for pyrolysis, but may also increases increase the value of effective thermal diffusivity within the formation 230.

It is noted that the operator may choose to inject gas without heating the gas. For example, the gas may be carbon dioxide, nitrogen or methane. Alternatively, the operator may choose to inject heated gas through a separate well spaced closely to the heat injection well 240. Preferably, the injected gas is substantially non-reactive in the organic-rich rock formation 230. For example, the gas may be nitrogen, carbon dioxide, methane, or combinations thereof.

As noted, the hydrocarbon development area 200 also includes a production well 260. The production well 260 provides a conduit for the transportation of hydrocarbon fluids from the organic-rich rock formation 230 to the surface 210.

The production well 260 is lined with a string of casing 270. The string of casing 270 is a surface casing. Again, because oil shale formations tend to be shallow, only the single string of casing 270 will typically be required. However, it is understood that a second or even third string of casing (not shown) may also be employed, depending on the completion depth.

The string of casing 270 has an upper end 272 at the surface 210. The upper end 272 is in sealed fluid communication with a lower valve as is common for a well tree. The string of casing 270 also has a lower end 274. Preferably, the lower end 274 extends to about the top of the organic-rich rock formation 230.

The string of casing 270 has a cement sheath 276 placed around at least the upper end 262 of the well 260. This serves to isolate strata and any aquitards in the subsurface 210. At its lower end 264, the production well 260 is completed as an open hole. The open hole extends substantially along the depth of the organic-rich rock formation 230.

The production well 260 also has a string of production tubing 280. The production tubing 280 has an upper end 282 at the surface 210. The upper end 282 is in sealed fluid communication with an upper valve as is common for a well tree. The string of production tubing 280 also has a lower end 284. Preferably, the lower end 284 extends to the lower portion 264 of the production well 240.

A lower portion 285 of the production tubing 280 extends along the depth of the organic-rich rock formation 230. Preferably, the lower portion 285 defines a slotted tubular body that permits the ingress of pyrolyzed production fluids into the production tubing 280. However, the lower portion may be a non-slotted tubing having an open lower end. In either instance, fluids "F" may travel up the bore 265 of the tubing 280 and to the surface 210 under reservoir pressure. Alternatively, an artificial lift system may be utilized. This may be, for example, an electrical submersible pump or a reciprocating mechanical pump.

A packer 266 is preferably provided for the production well 260. The packer 266 isolates an annular region 275 between the production tubing 280 and the surrounding casing 270. The packer 266 also directs production fluids "F" up the production casing 280.

Once production fluids "F" arrive at the surface 210, they pass through the well head 261. The production fluids "F" are transported through a fluids line 269 and to the fluids processing facility 225. The fluids processing facility 225 is shown schematically. However, it is understood that the fluids processing facility 225 will be made up of valves, pipes, gauges, separators, filters, and many other components. The present inventions are not limited to the arrangement of the fluids processing facility 225.

The purpose of the hydrocarbon development area 200 is to pyrolyze the organic-rich rock matrix within the formation 230 and capture valuable hydrocarbon fluids. As noted above, the organic-rich rock formation 230 is typically not a homogeneous rock body, but will have strata or sections representing different grades of solid hydrocarbon material.

It is desirable to provide a process by which pyrolysis oil may be upgraded in situ. More specifically, it is desirable to reduce the olefinic content of pyrolysis oil before the hydrocarbon fluids are produced to the surface. To accomplish this, it is proposed to produce the hydrocarbon fluids in such a way that the fluids contact residual solid carbon material, or coke, remaining in the subsurface from an earlier pyrolysis operation.

FIGS. 3A through 3D provide perspective views of hydrocarbon development areas, in different embodiments. Each hydrocarbon development area has a first zone that undergoes pyrolysis and production, and then a second zone that undergoes pyrolysis and production after the first zone.

Figure 3A:
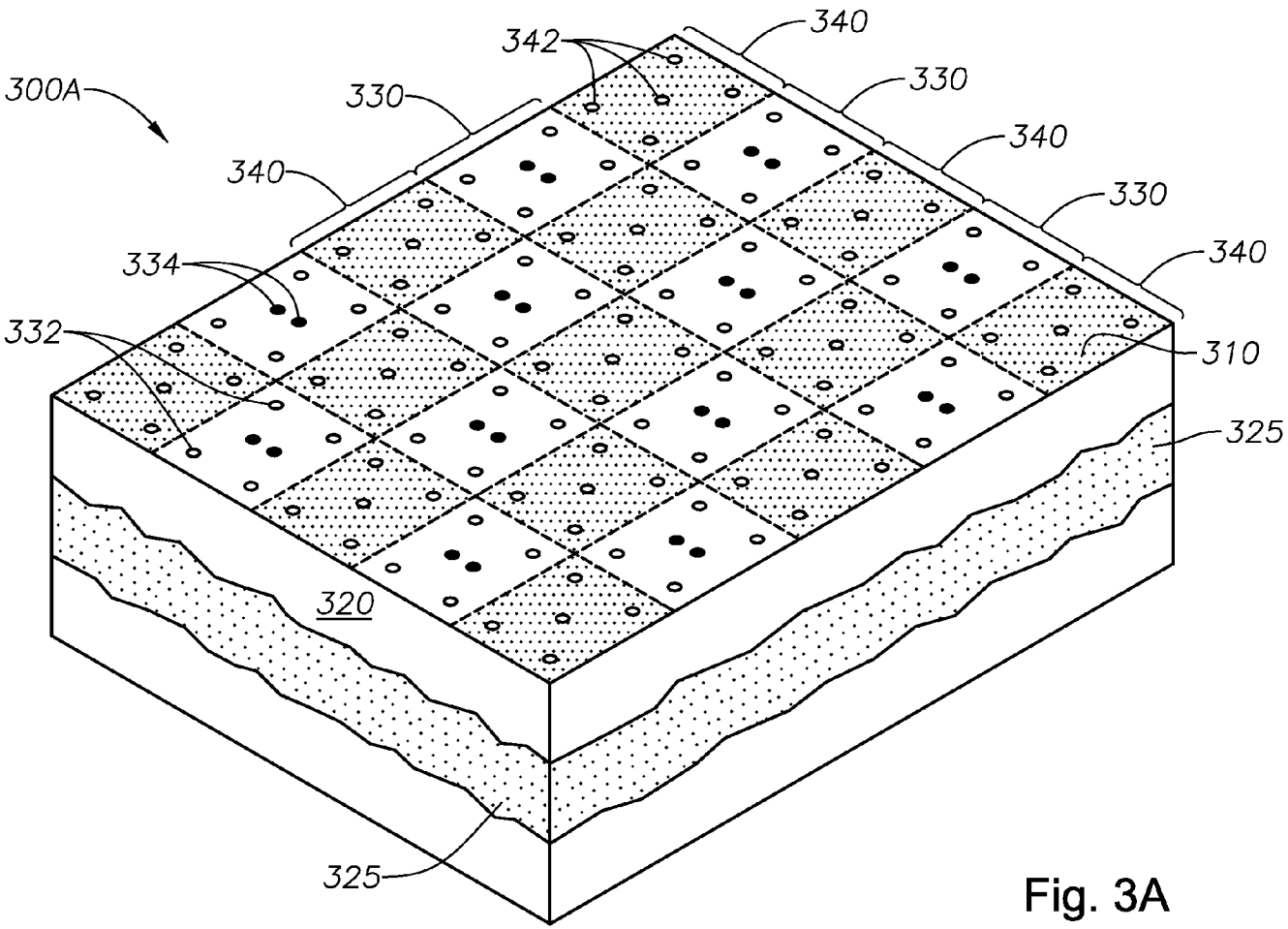
FIGS. 3A through 3D are perspective views of hydrocarbon development areas. Each hydrocarbon development area has a first zone that undergoes pyrolysis and production, and then a second zone that undergoes pyrolysis and production after the first zone.

FIG. 3A shows a hydrocarbon development area 300A in a first embodiment. The hydrocarbon development area 300A has a surface 310. The hydrocarbon development area 300A also has a subsurface 320. The subsurface 320 includes a formation 325 containing organic-rich rock. The organic-rich rock formation 325 may be an oil shale formation. Alternatively, the organic-rich rock formation 325 may be a heavy oil formation. In either event, the organic-rich rock formation 325 contains formation solids such as kerogen or tar sands that may be converted to hydrocarbon fluids upon the application of heat.

In order to generate heat in the formation 325, a plurality of heat injection wells is provided. In accordance with the present invention, heat injection wells are provided in two different zones. These represent a first zone 330 and a second zone 340. Heat injection wells are seen at 332 in the first zone 330 and at 342 in the second zone 340.

The heat injection wells 322, 342 may be in accordance with the arrangement of heater well 210 shown in FIG. 2. There, the heater well 240 uses an elongated conductive tubular body 250 to generate heat in the subsurface formation 230. However, the heat injection wells 332, 342 may use other electrically conductive members or particles to heat the formation 230. Further, the heat injection wells 322, 342, may comprise combustion heaters or any other type of heater suitable for creating temperatures within the subsurface formation 325 in excess of, for example, 270° C.

In order to convert solid hydrocarbons in the organic-rich rock formation 325 into hydrocarbon fluids, heat is applied to the subsurface formation 325 over time. For example, heat may be applied to the subsurface formation 325 in the first zone such that a temperature greater than 270° C. is maintained in the formation 325 for at least 12 weeks, and more preferably for at least 26 weeks. Alternatively, heat may be applied to the subsurface formation 325 in the first zone such that a temperature greater than 300° C. is maintained in the formation 325 for at least 8 weeks, and more preferably for at least 26 weeks. The same heat may be applied later to the formation 325 in the second zone 340.

In the illustrative hydrocarbon development area 300A of FIG. 3A, the first zone 330 and the second zone 340 are arranged in a checker-board pattern. Each zone 330, 340 is a four-sided polygon. The zones 330, 340 may be in the form of squares or rectangles. Alternatively, checkered patterns of triangles, hexagons, or combinations of shapes are possible.

In the illustrative area 300A, the zones 330, 340 are slightly elongated to form rectangular shapes. Elongation may be provided, for example, where the operator believes that heat may conduct through the organic-rich rock formation 325 faster in one direction than in another. In that instance, the individual zones 330, 340 may be elongated in the direction in which heat may conduct more efficiently. Elongation of zones may be employed where other shapes, such as pentagons or triangles, are employed as well.

In one aspect, heat may conduct more efficiently in a direction that is perpendicular to the direction of maximum principal stress in the rock. This may be, for example, where the formation 325 is more than 1,000 feet below the surface 310. In another aspect, heat may conduct more efficiently in a direction that is parallel to the direction of maximum principal stress in the rock. This may apply, for example, where the formation 325 is nominally less than 1,000 feet below the surface 310.

In either instance, the first zone 330, the second 340, or both may each constitute a volume having an areal extent of at least 1,000 $m^2$. Alternatively, the first zone 330, the second 340, or both may each constitute a volume having an areal extent of at least 4,000 $m^2$.

Referring specifically to the first zone 330, each section representing the first zone 330 includes a plurality of heat injection wells and a plurality of production wells. As noted, the heat injection wells are shown at 332, while the production wells are shown at 334. In each of the illustrative sections forming the first zone 330, four heat injection wells 332 and two production wells 334 are shown. This creates something of a modified five-spot pattern wherein two production wells 334 are used rather than just one. However, other arrangements may be employed. Such other arrangements may be, for example, a seven-spot pattern or a nine-spot pattern. Further, each section forming the first zone 330 may have many more heat injection wells 332 and production wells 334 so that more than one five-spot or seven-spot or nine-spot pattern of wells is created.

Referring now to the second zone 340, each section representing the second zone 340 also includes a plurality of heat injection wells. As noted, the heat injection wells are shown at 342. However, no production wells are shown. In each of the illustrative sections forming the second zone 340, five heat injection wells 342 are shown in a five-spot pattern. However, other arrangements may be employed. Such other arrangements may be, for example, a seven-spot pattern or a nine-spot pattern. Further, each section forming the second zone 340 may have many more heat injection wells 342 so that more than one five-spot or seven-spot or nine-spot pattern of wells is created.

In operation, the heat injection wells 332 of the first zone 330 are actuated so as to heat the subsurface formation 325. After solid hydrocarbons are pyrolyzed or otherwise converted to flowable hydrocarbon fluids, the production wells 334 are actuated. In this way, valuable hydrocarbon fluids are recovered at the surface 310.

The process of converting hydrocarbon solids or mobilizing highly viscous hydrocarbons leaves a residual solid carbon material known as coke. The coke remains locked within the matrix of the organic-rich rock making up the subsurface formation 325. The coke also contains hydrogen atoms. It is believed that by passing pyrolysis oil through the organic-rich rock and the coke residue, the hydrogen atoms will transfer to carbon atoms in the pyrolysis oil. More specifically, olefins within the pyrolysis oil will be hydrogenated and upgraded to a higher quality hydrocarbon fluid.

To enable this process, it is beneficially proposed herein to pyrolyze or otherwise convert hydrocarbon solids or highly viscous hydrocarbons in the second zone 340 and then pass the newly-formed hydrocarbon fluids across the coke remaining in the first zone 330. Thus, at some point after production has commenced from the production wells 334 in the first zone 330, the heat injection wells 342 in the second zone 340 are actuated. In one aspect, the heat injection wells 342 in the second zone 340 are actuated one month after production commences in the first zone 330. More preferably, the heat injection wells 342 in the second zone 340 are actuated between 6 months and 24 months after production commences in the first zone 330. In one aspect, heating is commenced in the second zone 340 6 months to 24 months after heating is commenced in the first zone 330. In another aspect heating is commenced in the second zone 340 within 1 month to 12 months after production in the first zone 330 is substantially terminated.

Actuating the heat injection wells 342 in the second zone 340 will pyrolyze or otherwise convert hydrocarbon solids or highly viscous hydrocarbons in the second zone 340 into hydrocarbon fluids. However, the hydrocarbon fluids are not significantly produced from the sections forming the second zone 340. Indeed, in the illustrative development area 300A of FIG. 3A, no production wells are provided in the second zone 340. Instead, hydrocarbon fluids will flow from the second zone 340 into the first zone 330. The hydrocarbon fluids will flow through the rock matrix comprising the organic-rich rock formation 325, will be produced through the plurality of production wells 334 in the first zone 330, and will then flow up to the surface 310. In one aspect, the production of hydrocarbon fluids from the second zone 340 commences within 1 month to 12 months after the organic-rich rock formation 325 in the first zone 330 has been substantially pyrolyzed.

It is understood that hydrocarbon fluids produced from both the first zone 330 and the second zone 340 will be processed in a fluids processing facility (not shown). Part of the processing will involve the separation of compressible hydrocarbon fluids (gas) from incompressible hydrocarbon fluids (oil). Incidental water production will also be separated. Regardless of the manner in which processing takes place, the composition of the hydrocarbon fluids produced from the first 330 and second 340 zones together will have a lower average olefinic content than the hydrocarbon fluids produced from the first zone 330 alone.

The well arrangement shown in FIG. 3A offers another benefit to the quality of hydrocarbon fluids. In this respect, mobilized hydrocarbon fluids are offered a flow path to production wells 334 wherein the majority of hydrocarbons generated by heat from each heater well 332, 342 are able to migrate to a production well 334 without passing across another heater well. Alternatively, the majority of mobilized hydrocarbon fluids are offered a flow path to production wells 334 wherein the majority of hydrocarbons generated by heat from each heater well 342 in the second zone 340 are able to migrate to a production well 334 without passing through an area of substantially increasing formation temperature. This prevents "over-cooking" of the mobilized hydrocarbons in situ.

Figure 3B:
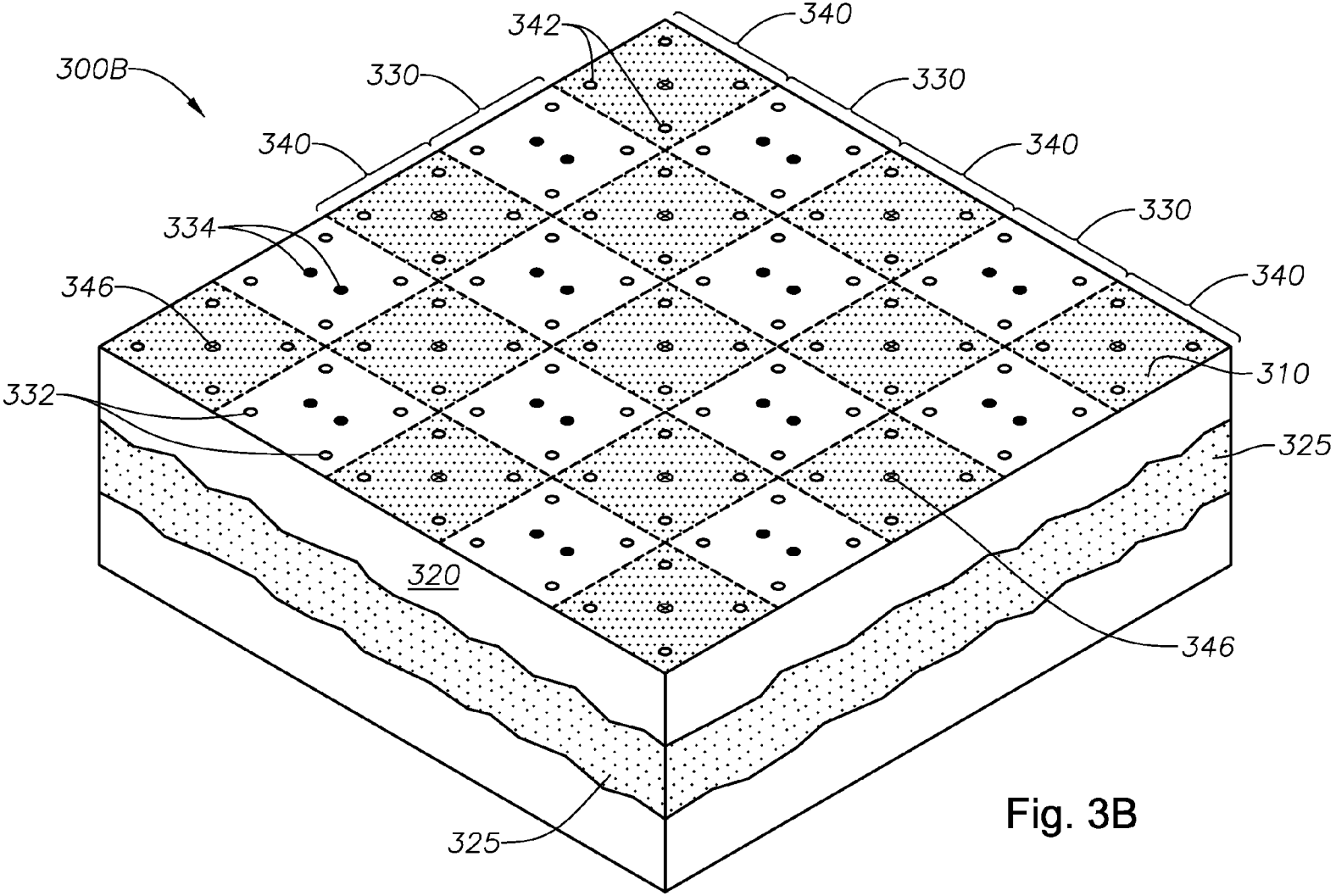

Other arrangements for hydrocarbon development areas are offered herein. FIG. 3B shows a hydrocarbon development area 300B in a second embodiment. The hydrocarbon development area 300B is generally arranged in accordance with the hydrocarbon development area 300A. In this respect, the development area 300B is also arranged with a first zone 330 and a second zone 340 in a checker-board pattern. However, in the development area 300B, some of the heat injection wells in the sections of the second zone 340 have been converted to gas injection wells. The gas injection wells are seen at 346.

The benefit of the gas injection wells 346 is that the injection of gas during the heating process may increase thermal diffusivity of the rock matrix in the formation 325. Further the injection of gas may increase pressure in the subsurface formation corresponding to the sections of the second zone 340, driving converted hydrocarbon fluids to the production wells 334 in the first zone 330.

Figure 3C:
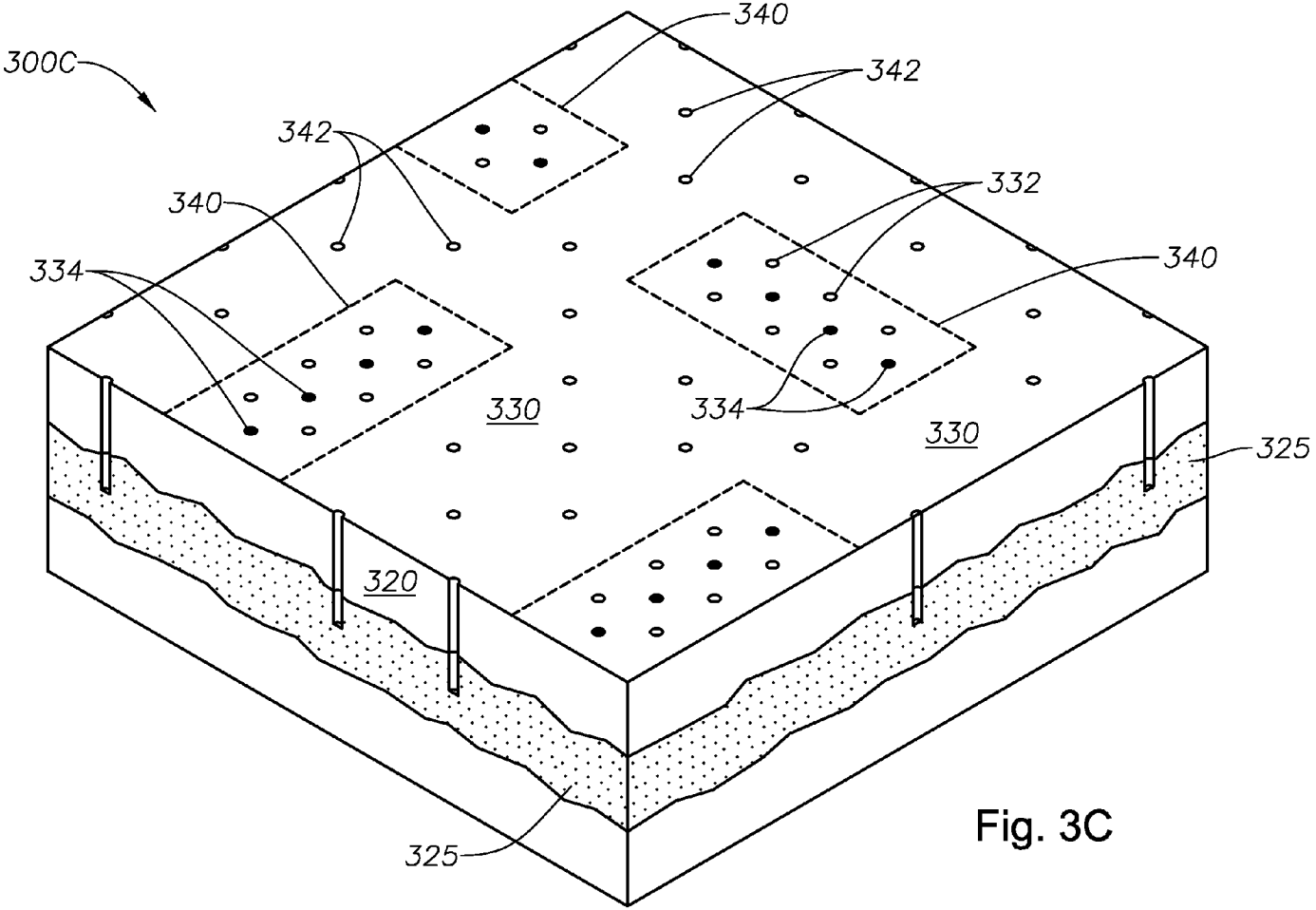

Yet another arrangement for a hydrocarbon development area is provided in FIG. 3C. FIG. 3C shows a hydrocarbon development area 300C in a third embodiment. Here, the geometric configurations of the first 330 and second 340 zones have been modified. Individual sections forming the first zone 330 have been doubled in size. Further, the areal extent of the second zone 340 is significantly larger than the areal extent of the first zone 330.

Heat injection wells 332 and production wells 334 are shown in the first zone 330 in five-spot patterns. Heat injection wells 342 are shown dispersed throughout the second zone 340.

Figure 3D:
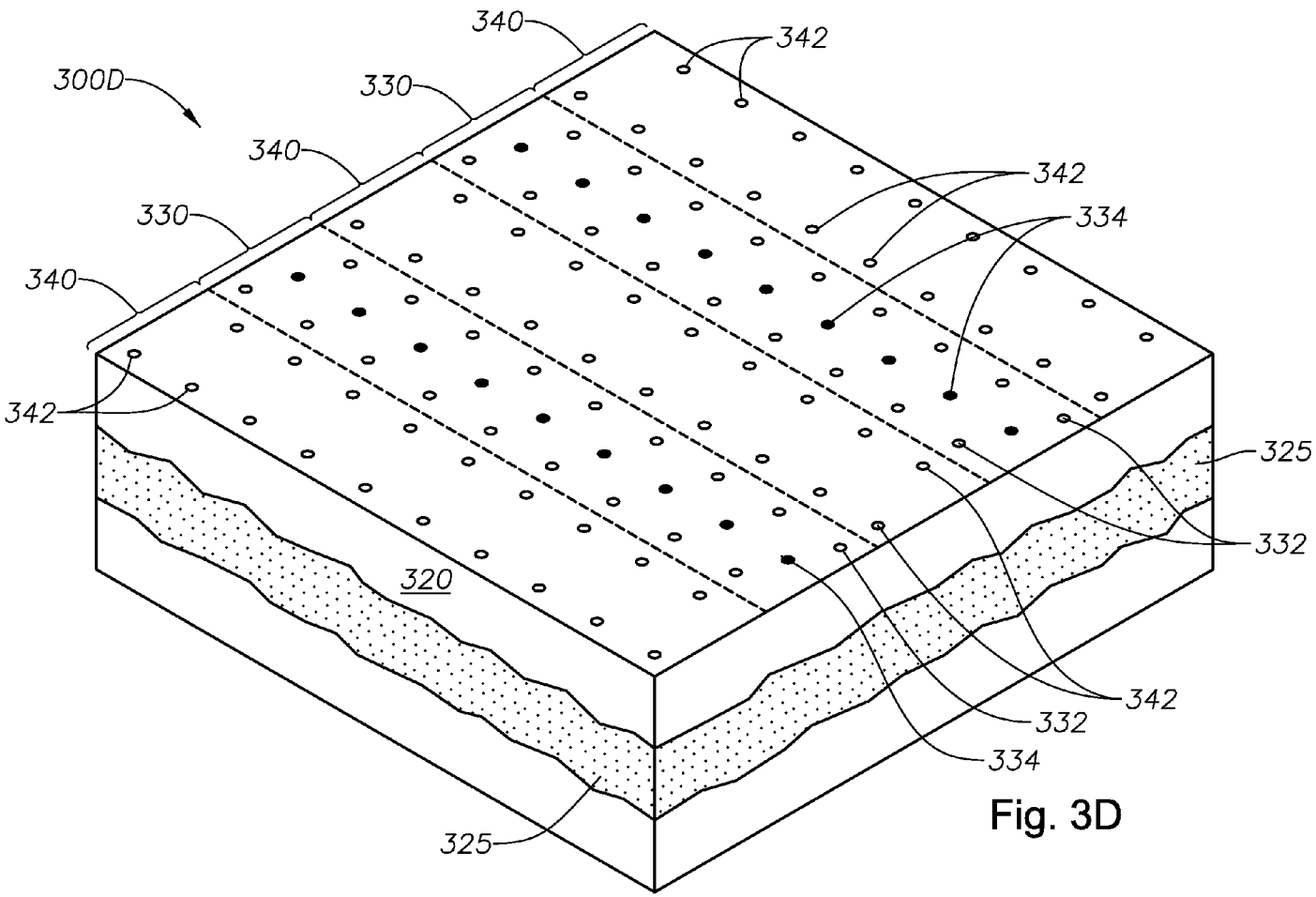

Yet a further arrangement for a hydrocarbon development area is provided in FIG. 3D. FIG. 3D shows a hydrocarbon development area 300D in a fourth embodiment. Here, the respective first 330 and second 340 zones are arranged in parallel TOWS.

Heat injection wells 332 and production wells 334 are shown in the first zone 330 in five-spot patterns. Heat injection wells 342 are shown in linear arrangement in the second zone 340.

As with the previous FIGS. 3A through 3C, in the hydrocarbon development area 300D of FIG. 3D heating and production takes place in the first zone 330, followed by heating and production in the second zone 340. Mobilized hydrocarbon fluids flow from the rows forming the second zone 340 into the rows forming the first zone 330. As fluids flow into the rows forming the first zone 330, hydrocarbon fluids will pass through coke embedded in the rock matrix. This will hydrogenate the hydrocarbon fluids, reducing the olefin content before production through the production wells 334.

In the arrangements for a hydrocarbon development area provided in FIGS. 3A through the 3D, the sections forming the second zone 340 are adjacent to or even contiguous with the sections forming the first zone 330. In these instances, mobilized hydrocarbon fluids are able to flow from the second zone 330 and into the first zone 340 through the permeable rock matrix in the subsurface formation 325. However, the present invention also allows for production where the second zone 330 is not adjacent to the first zone 340.

Figure 4A:
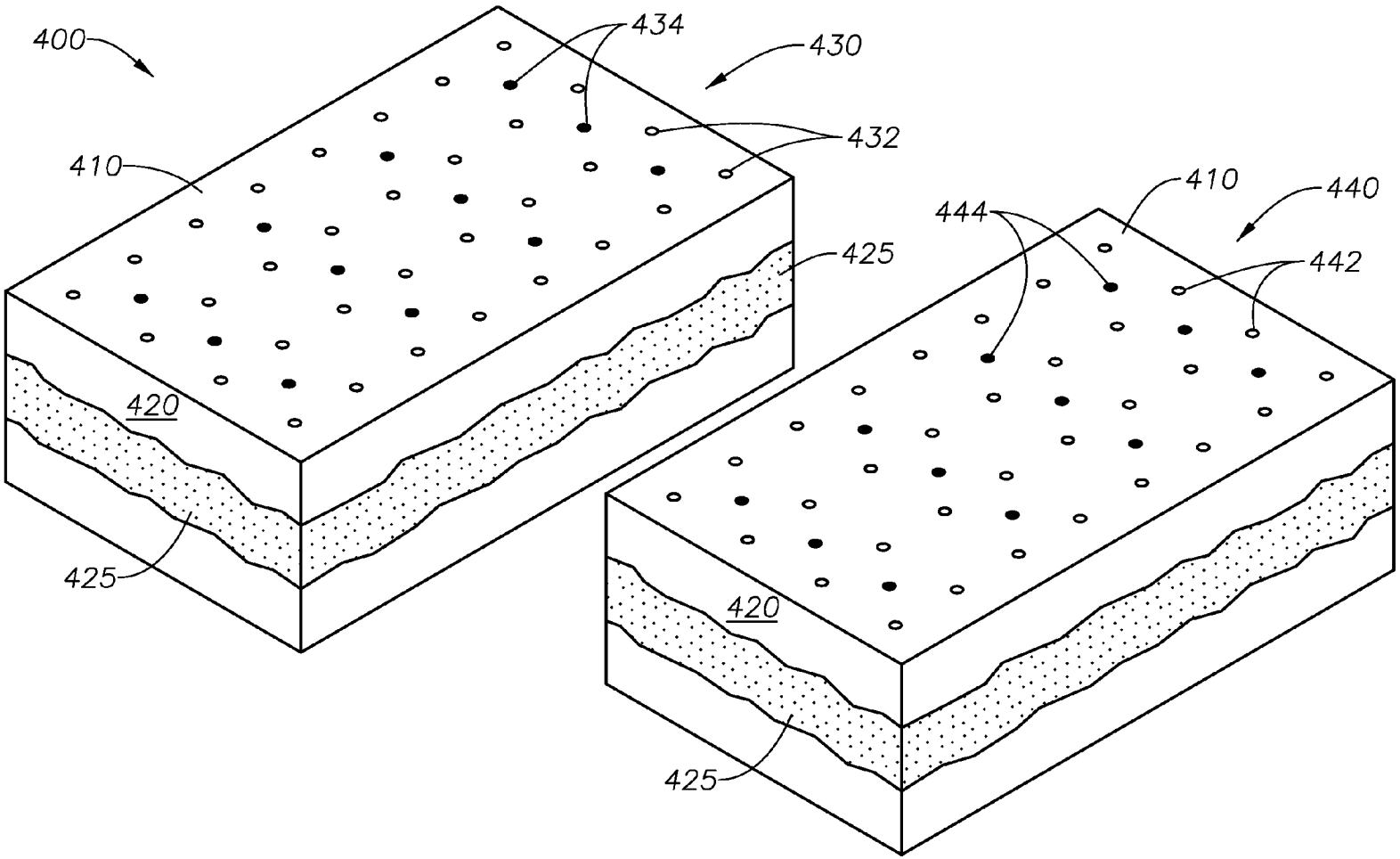
FIGS. 4A through 4B are perspective views of a hydrocarbon development area. The area has a first zone that undergoes pyrolysis and production first, and a second zone that undergoes pyrolysis and production second. However, the first and second zones are not contiguous.
Figure 4B:
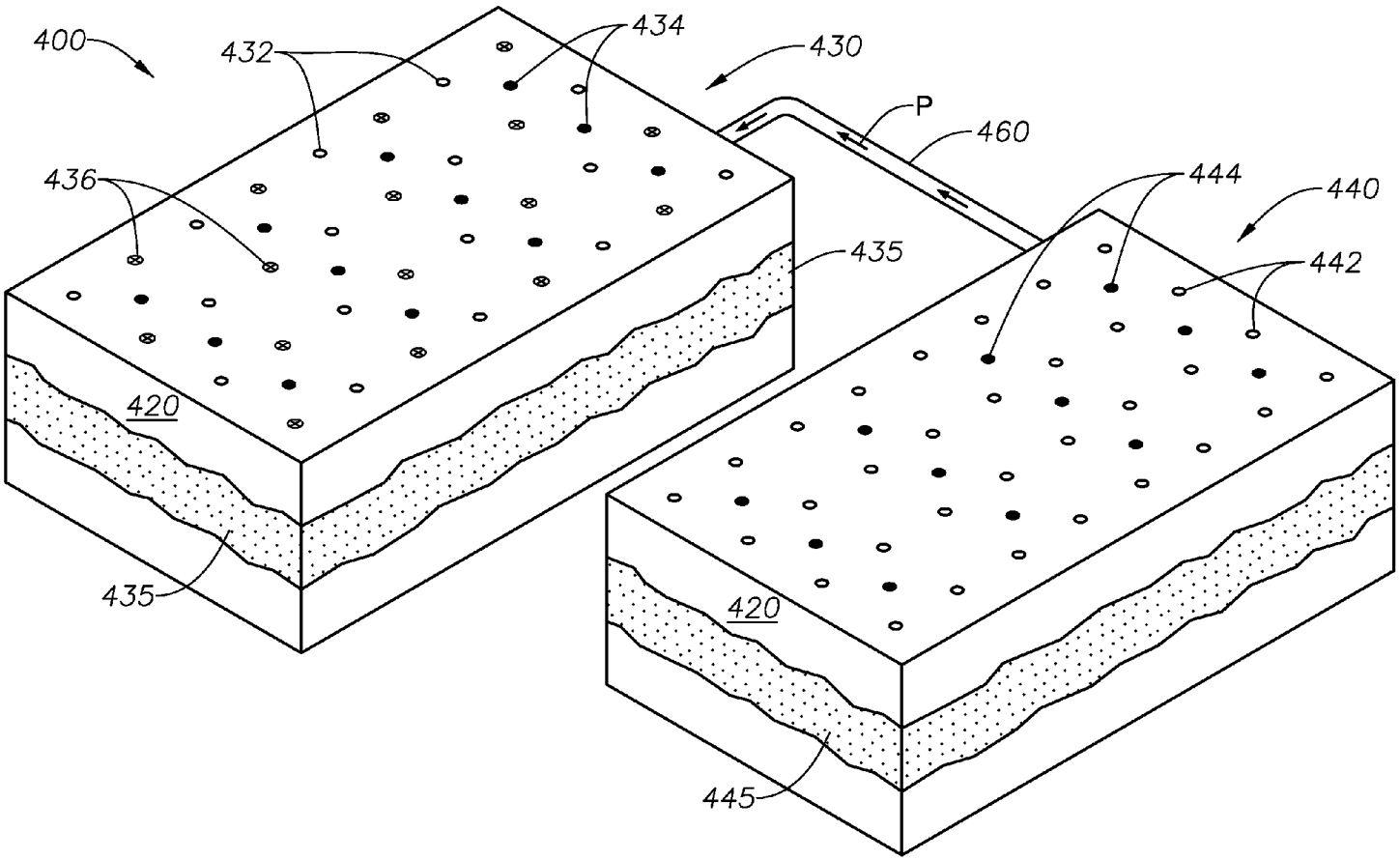

FIGS. 4A and 4B provide perspective views of a hydrocarbon development area 400. The hydrocarbon development area 400 has a surface 410. The hydrocarbon development area 400 also has a subsurface 420. The subsurface 420 includes a formation 425 containing organic-rich rock. The organic-rich rock formation 425 may be an oil shale formation. Alternatively, the organic-rich rock formation 425 may be a heavy oil formation. In either event, the organic-rich rock formation 425 contains formation solids such as kerogen, or contains heavy oil such as bitumen, that may be converted to flowable hydrocarbon fluids upon the application of heat.

The hydrocarbon development area 400 has been divided into two separate zones. These represent a first zone 430 and a second zone 440. The first zone 430 undergoes pyrolysis and production first, and the second zone 440 undergoes pyrolysis and production after the production has commenced in the first zone 430. In one aspect, heating is commenced in the second zone 440 six to 24 months after heating is commenced in the first zone 430. In another aspect, heating is commenced in the second zone 440 six to 24 months after production is commenced in the first zone 430. In still another aspect heating is commenced in the second zone 440 within 1 month to 12 months after production in the first zone 430 is substantially terminated.

In order to generate heat in the formation 425, a plurality of heat injection wells is provided. Heat injection wells are provided in each of the first 430 and second 440 zones. The heat injection wells in the first zone 430 are shown at 432, while the heat injection wells in the second zone 440 are shown at 442.

The heat injection wells 432, 442 may be in accordance with the arrangement of heater well 210 shown in FIG. 2. There, the heater well uses an elongated conductive tubular body to generate heat in the subsurface. However, the heat injection wells 432, 442 may be downhole combustion heaters or any other type of heater suitable for creating temperatures within the subsurface formation 425 in excess of 270° C.

In order to convert solid hydrocarbons in the organic-rich rock of the formation 425 into hydrocarbon fluids, heat is applied to the subsurface formation 425 over time. For example, heat may be applied to the subsurface formation 425 in the first zone 430 such that a temperature greater than 270° C. is maintained in the formation 425 for at least twelve weeks, and more preferably for at least 26 weeks. Alternatively, heat may be applied to the subsurface formation 425 in the first zone 430 such that a temperature greater than 300° C. is maintained in the formation 425 for at least eight weeks, and more preferably for at least 26 weeks.

Converted hydrocarbons are produced from the first zone 430 through production wells 434. A plurality of production wells 434 is provided in the first zone 430. The production wells 434 are spaced among the heat injection wells 432 to capture hydrocarbon fluids.

Production wells are also provided in the second zone 440. Production wells are seen at 444. However, in the view of FIG. 4A, the production wells 444 are not yet producing. The heat injection wells 442 in the second zone 440 have been actuated to begin heating the subsurface formation 425 within the second zone 440, but production has not yet begun.

At some point after heating in the second zone 440 commences, production in the second zone 440 will begin. In one aspect, production in the second zone 440 begins one month after heating commences in the second zone 440. Alternatively, production in the second zone 440 begins between three months and twelve months after heating commences in the second zone 440.

FIG. 4B shows the hydrocarbon development area 400 of FIG. 4A, with the second zone 440 now undergoing production. Pyrolysis oil and pyrolysis gas are being produced through the production wells 444. In addition, produced pyrolysis oil and pyrolysis gas are being transported to the first zone 430 for injection and subsequent production through the production wells 434 of the first zone 430. The movement of produced pyrolysis oil and pyrolysis gas from the second zone 440 to the first zone 430 is shown at arrow "P." Hydrocarbon fluids are then produced from the plurality of production wells 434 in the first zone 430, and up to the surface 410.

As with the hydrocarbon development areas of FIGS. 3A through 3D, in hydrocarbon development area 400 converted fluids generated from the heating in the second zone 440 are passed through the subsurface formation 425 in the first zone 430. Passing the newly-formed hydrocarbon fluids through the solid carbon material remaining in the first zone 430 from pyrolysis provides for hydrogenation of the converted hydrocarbon fluids produced from the subsurface formation 425 in the second zone 440.

It is noted here that in the hydrocarbon development areas of FIGS. 3A through 3D, the first zone 330 and the second zone 340 are arranged to be contiguous. However, in the arrangement for the hydrocarbon development area 400, the first zone 430 and the second zone 440 are not contiguous. To allow produced fluids to flow from the subsurface formation 425 in the second zone 440 to the subsurface formation 425 in the first zone 430, a fluid line 460 is provided. The fluid line 460 may be above or below ground. Optionally, selected heat injection wells 432 in the first zone 430 are converted to hydrocarbon injection wells. The illustrative converted wells are seen at 436. Produced fluids in the fluid line 460 are directed to the hydrocarbon injection wells 436 and are injected into the subsurface formation 425. Thus, the fluid line 460 and the one or more hydrocarbon injection wells 436 together comprise a tubular body. The hydrocarbons are then re-produced through the production wells 434 in the first zone 430.

It is understood that hydrocarbon fluids produced from the first zone 430 will be processed in a fluids processing facility (not shown). Part of the processing will involve the separation of compressible hydrocarbon fluids (gas) from incompressible hydrocarbon fluids (oil). Incidental water production will also be separated. In addition, some fluid processing may optionally take place with the fluids produced from the second zone 440, such as before the fluids enter fluid line 460. This would be for the purpose of removing pyrolysis gas and water from hydrocarbon fluids injected through the injection wells 436. Regardless of the manner in which processing takes place, the composition of the hydrocarbon fluids produced from the first 430 and second 440 zones together will have a lower average olefinic content than the hydrocarbon fluids produced from the first zone 430 alone.

Olefin content may be measured by several ways known in the art. These include mass spectroscopy and chemical titration. Standardized methods include ASTM 1159-07 ("Standard Test Method for Bromine Numbers of Petroleum Distillates and Commercial Olefins by Electrometric Titration") and ASTM D1319-03 ("Standard Test Method for Hydrocarbon Types in Liquid Petroleum Products by Indicator Adsorption"). Poirier and George describe a method for determining the olefinic content of saturated and aromatic fraction of petroleum distillates by hydroboration. (See *Fuel,* 60 (3), pp. 194-196 (March 1981). Olefin content may be determined with reference to a bromine number. "Bromine number" refers to a weight percentage of olefins in grams per 100 gram of portion of a produced fluid that has a boiling range below 246° C. The portion is tested using ASTM Method D1159. Ruzicka and Vadum describe a modified method to determine bromine number to measure undersaturation of heavy fuels. (*See Oil & Gas Journal,* 85 (31), pp. 48-50 (Aug. 3, 1987). The claims below are not limited by the technique used to determine olefin content unless so stated.

Figure 5:
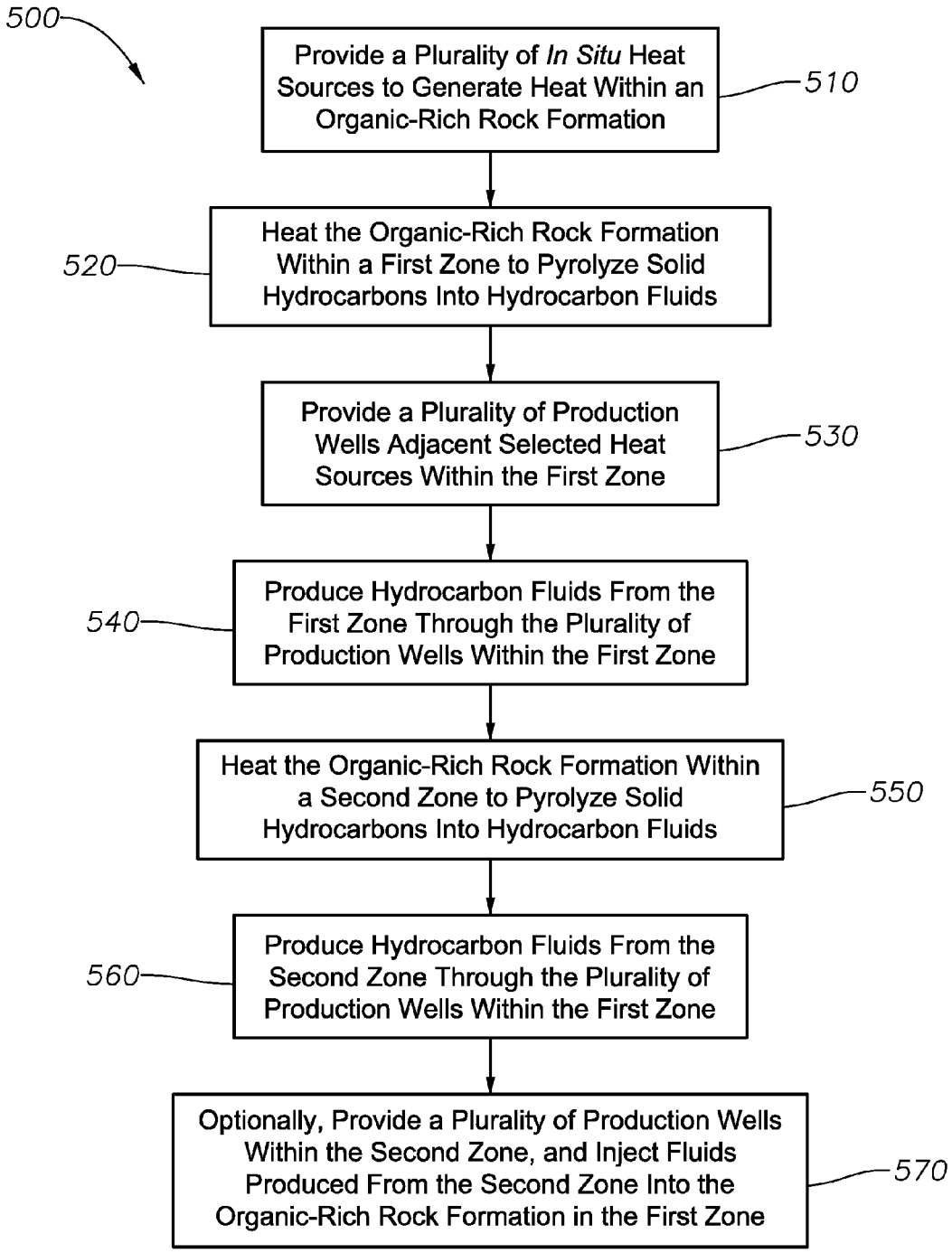
FIG. 5 presents a flow chart demonstrating steps for a method of producing hydrocarbon fluids from an organic-rich rock formation to a surface facility.

Based on the illustrative figures described above, a method for producing hydrocarbon fluids may be provided. FIG. 5 presents a flow chart demonstrating steps for a method 500 of producing hydrocarbon fluids from an organic-rich rock formation, in one embodiment. The organic-rich rock formation comprises formation hydrocarbons such as solid hydrocarbons or heavy hydrocarbons. In one aspect, the organic-rich rock formation is an oil shale formation. The formation may have an initial permeability of, for example, less than about 10 millidarcies.

The method 500 includes providing a plurality of in situ heat sources. This is seen at Box 510. Each heat source is configured to generate heat within the organic-rich rock formation. Various types of heat sources may be used for heating. These include:

(i) an electrical resistance heater wherein resistive heat is generated from an elongated metallic member within a wellbore, and where an electrical circuit is formed using granular material within the wellbore or a conductive member such as a centralizer or a wire, (ii) an electrical resistance heater wherein resistive heat is generated primarily from a conductive granular material within a wellbore, (iii) an electrical resistance heater wherein resistive heat is generated primarily from a conductive granular material disposed within the organic-rich rock formation between two or more adjacent wellbores to form an electrical circuit, (iv) an electrical resistance heater wherein heat is generated primarily from elongated, electrically conductive metallic members in adjacent wellbores, and where an electrical circuit is formed using conductive granular material within the formation between the adjacent wellbores, (v) a downhole combustion well wherein hot flue gas is circulated within a wellbore or between connected wellbores, (v) a closed-loop circulation of hot fluid through the organic-rich rock formation, (vi) a closed-loop circulation of hot fluid through a wellbore, or (vii) combinations thereof.

The method 500 also includes heating the organic-rich rock formation in situ. More specifically, heating is provided in a first selected zone. This is shown in Box 520. The first zone may constitute a volume having an areal extent of at least 1,000 $m^2$. Alternatively, the first zone may constitute a volume having an areal extent of at least 4,000 $m^2$.

The purpose of heating is to cause pyrolysis of formation hydrocarbons. Preferably, the organic-rich rock formation is heated to a temperature of at least 200° C. Where the formation is an oil shale formation, the temperature is at least 270° C. Heating of the organic-rich rock formation continues so that heat moves away from the respective heat sources and through the subsurface formation in the first zone.

The method also includes providing a plurality of production wells adjacent selected heat sources. This is shown at Box 530. The production wells are located within the first zone. The method then comprises producing hydrocarbon fluids from the first zone through the plurality of production wells within the first zone. This is provided at Box 540.

The method additionally includes heating the organic-rich rock formation in situ within a second selected zone. This step is seen at Box 550. The second zone may also constitute a volume having an areal extent of at least 1,000 $m^2$. Alternatively, the second zone may constitute a volume having an areal extent of at least 4,000 $m^2$. Heating of the organic-rich rock formation continues so that heat moves away from heat sources and through the second zone. In this way a temperature of at least 200° C. is created within the organic-rich rock formation proximal the heat sources within the second zone. Where the formation is an oil shale formation, the temperature is at least 270° C. The heat sources may be heat injection wells, circulated fluid, or resistive granular material placed within the formation.

The method also includes producing hydrocarbon fluids from the second zone. This is shown at Box 560. Production takes place through the plurality of production wells within the first zone. During production, the pressure of the production wells is controlled such that the generated pyrolysis oil is caused to migrate through subsurface coked areas in the first zone which have been previously pyrolyzed. In this way, hydrocarbon fluids produced from the second zone contact coke within the rock matrix in the first zone. Preferably the first zone was substantially pyrolyzed, thus producing substantial volumes of coke prior to flowing fluids from the second zone through the first zone.

It is preferred that the coked first zone through which generated pyrolysis oil from the second zone is flowed is still hot. The temperature should be greater than 200° C., and more preferably greater than 300° C., on average. However, the coked first zone preferably is not so hot as to cause substantial secondary cracking in the pyrolysis oil from the second zone. Thus, preferably the coked first zone is at a temperature that is less than 400° C., on average.

The second zone may be contiguous to the first zone. In this instance, flow communication between the second zone and the first zone is provided by porous flow through the subsurface rock. In one aspect, pyrolysis oil may flow through several previously-heated first zones to arrive at production wells. In addition, pyrolysis oil from the second zone may flow through a permeable zone or a fractured zone which has not yet been pyrolyzed before arriving at the coked first zone for production.

As an alternative, the second zone may be apart or remotely located from the first zone. In this instance, a tubular body is used to provide fluid communication between the second zone and the first zone. In this latter instance, the method will include providing a plurality of production wells within the second selected zone, and then injecting fluids produced from the second zone into the organic-rich rock in the first zone. This optional process is seen at Box 570. In either instance, hydrocarbon fluids are produced from the second zone through the plurality of production wells within the first zone in accordance with Box 560.

It is believed that contacting hydrocarbon liquids generated by pyrolysis with freshly formed coke can hydrogenate olefins in the pyrolysis oil. This, in turn, leads to a more compositionally stable oil. This hydrogenation behavior has been demonstrated experimentally by Freund and Kelemen (see "Low-Temperature Pyrolysis of Green River Kerogen, *AAPG Bulletin,* 73 (8), pp. 1011-1017 (August 1989)). In particular, Freund and Kelemen found that naphthenoaromatic hydrogen within coke resulting from pyrolyzed kerogen can serve as the hydrogen source for hydrogenation of olefins into saturated hydrocarbons.

In accordance with the method 500 herein, the composition of the hydrocarbon fluids produced from the first and second zones together has a lower average olefinic content than the hydrocarbon fluids produced from the first zone alone. Olefinic content may refer to olefinic content of a liquid distillate cut with an atmospheric bubble point less than about 330° C. In another aspect, lower olefinic content reflects diolefinic content.

While it will be apparent that the inventions herein described are well calculated to achieve the benefits and advantages set forth above, it will be appreciated that the inventions are susceptible to modification, variation and change without departing from the spirit thereof.

What is claimed is:

1. A method for producing hydrocarbon fluids from an organic-rich rock formation to a surface facility, comprising:

providing a plurality of in situ heat sources, each of the plurality of in situ heat sources being configured to generate heat within the organic-rich rock formation and convert organic-rich rock into hydrocarbon fluids;

heating the organic-rich rock formation in situ within a first zone so that a temperature of at least 270° C. is created within the organic-rich rock formation proximal the plurality of in situ heat sources within the first zone, and so that coke is formed;

providing a plurality of production wells adjacent selected ones of the plurality of in situ heat sources within the first zone;

producing hydrocarbon fluids of a first composition from the first zone through the plurality of production wells within the first zone;

heating the organic-rich rock formation in situ within a second zone so that a temperature of at least 270° C. is created within the organic-rich rock formation proximal the plurality of in situ heat sources within the second zone;

producing hydrocarbon fluids of a second composition from the second zone, the second composition of hydrocarbon fluids having a lower average olefinic content than the first composition of hydrocarbon fluids by transporting the hydrocarbon fluids produced from the second zone through the plurality of production wells within the first zone such that that hydrocarbon fluids produced from the second zone contact coke within a rock matrix in the first zone;

wherein the olefinic content refers to olefinic content of a liquid distillate cut with an atmospheric bubble point less than about 330° C.

2. The method of claim 1, wherein the organic-rich rock formation comprises heavy hydrocarbons.

3. The method of claim 1, wherein the organic-rich rock formation comprises solid hydrocarbons.

4. The method of claim 3, wherein:

the organic-rich rock formation is an oil shale formation;

the organic-rich rock comprises kerogen; and the first zone and the second zone are each heated to a temperature of at least 270° C.

5. The method of claim 4, wherein the oil shale formation has an initial permeability of less than about 10 millidarcies.

6. The method of claim 1, wherein each of the plurality of in situ heat sources comprises:

(i) an electrical resistance heater wherein resistive heat is generated within a wellbore primarily from an elongated metallic member, (ii) an electrical resistance heater wherein resistive heat is generated primarily from a conductive granular material within a wellbore, (iii) an electrical resistance heater wherein resistive heat is generated primarily from a conductive granular material disposed within the organic-rich rock formation, (iv) a downhole combustion well wherein hot flue gas is circulated within a wellbore or through fluidly connected wellbores, (v) a closed-loop circulation of hot fluid through the organic-rich rock formation, (vi) a closed-loop circulation of hot fluid through a wellbore, or (vii) combinations thereof.

7. The method of claim 1, wherein lower olefinic content reflects diolefinic content.

8. The method of claim 1, wherein flow communication between the first zone and the second zone is provided by porous flow through the organic-rich rock formation.

9. The method of claim 1, wherein flow communication between the first zone and the second zone is provided by one or more tubular bodies for fluid communication between the first zone and the second zone.

10. The method of claim 9, wherein:

the first zone and the second zone are not contiguous; and the one or more tubular bodies comprises a fluid line above a around level carrying hydrocarbon fluids from the first zone to the second zone, and at least one hydrocarbon injection well for injecting hydrocarbon fluids into the organic-rich rock formation in the first zone.

11. The method of claim 1, wherein flow communication between the first zone and the second zone is provided by one or more naturally occurring subsurface fractures in a rock matrix that has not been heated to a pyrolysis temperature.

12. The method of claim 1, wherein the first zone is at a temperature between 200° C. and 400° C. during production of fluids from the second zone.

13. The method of claim 1, wherein heating the organic-rich rock formation in situ within the first zone comprises maintaining the temperature within the first zone at a temperature greater than 300° C. for at least 8 weeks.

14. The method of claim 1, wherein the first zone constitutes a volume having an areal extent of at least 1,000 $m^2$.

15. The method of claim 1, wherein the first zone constitutes a volume having an areal extent of at least 4,000 $m^2$.

16. The method of claim 1, wherein the second zone is contiguous with the first zone.

17. The method of claim 1, wherein heating the organic-rich rock formation within the second zone commences about 6 months to 24 months after production commences in the organic-rich rock formation within the first zone.

18. The method of claim 1, wherein heating the organic-rich rock formation within the second zone commences about 6 months to 24 months after heating is commenced in the first zone.

19. The method of claim 1, wherein heating the organic-rich rock formation within the second zone commences within 1 month to 12 months after production in the first zone is substantially terminated.

20. The method of claim 1, wherein production of hydrocarbon fluids from the second zone commences within 1 month to 12 months after the organic-rich rock formation in the first zone has been substantially pyrolyzed.

21. The method of claim 1, wherein producing hydrocarbon fluids from the second zone commences about 3 months to 12 months after heating commences in the organic-rich rock formation within the second zone.

22. A method for hydrogenating pyrolysis oil from an oil shale formation, comprising:

providing a plurality of in situ heat sources, each of the plurality of in situ heat sources being configured to generate heat within the oil shale formation so as to pyrolyze solid hydrocarbons into pyrolysis oil;

heating the oil shale formation in situ within a first zone so that a temperature of at least 270° C. is created within the organic-rich rock formation proximal the plurality of in situ heat sources within the first zone and forming residual solid carbon molecules;

providing a plurality of production wells adjacent selected ones of the plurality of in situ heat sources within the first zone;

producing hydrocarbon fluids of a first composition from the first zone through the plurality of production wells within the first zone;

heating the organic-rich rock formation in situ within a second zone so that a temperature of at least 270° C. is created within the oil shale formation proximal the plurality of in situ heat sources within the second zone;

producing hydrocarbon fluids of a second composition from the second zone, the second composition of hydrocarbon fluids having a lower average olefinic content than the first composition of pyrolysis oil by transporting the pyrolysis oil produced from the second zone through the plurality of production wells within the first zone such that that hydrocarbon fluids produced from the second zone contact residual solid carbon molecules within the oil shale formation in the first zone, thereby hydrogenating pyrolysis oil and reducing olefinic content;

wherein the olefinic content refers to olefinic content of a liquid distillate cut with an atmospheric bubble point less than about 330° C.

23. The method of claim 22, further comprising:

injecting a gas into the oil shale formation in the second zone while producing pyrolysis oil from the second zone, the injected gas comprising (i) nitrogen, (ii) carbon dioxide, (iii) methane, or (iv) combinations thereof.

24. The method of claim 22, wherein the first zone comprises a plurality of non-contiguous sections, each of the plurality of non-contiguous sections having at least one heat injection well and at least one of the plurality of production wells.

25. The method of claim 22, wherein the second zone comprises a plurality of non-contiguous sections, each of the plurality of non-continuous sections having at least one heat injection well.

26. The method of claim 25, wherein the sections of the first zone and the plurality of non-continuous sections of the second zone are arranged in alternating rows or in a checkerboard pattern.

27. The method of claim 22, wherein the first zone and the second zone are contiguous.

28. The method of claim 22, wherein:

the first zone and the second zone are not contiguous; and flow communication between the first zone and the second zone is provided by one or more tubular bodies providing fluid communication between the first zone and the second zone, the tubular bodies comprising a fluid line above a around level carrying hydrocarbon fluids from the first zone to the second zone, and at least one hydrocarbon injection well for injecting hydrocarbon fluids into the organic-rich rock formation in the first zone.

29. The method of claim 22, wherein the first zone is at a temperature between about 200° C. and 400° C. during production of fluids from the second zone.

30. The method of claim 22, wherein production of hydrocarbon fluids from the second zone commences within 1 month to 12 months after the organic-rich rock formation in the first zone has been substantially pyrolyzed.

* * * * *